US006954029B2

(12) United States Patent
Mikaki et al.

(10) Patent No.: US 6,954,029 B2
(45) Date of Patent: Oct. 11, 2005

(54) BACK PANEL AND/OR SPACER FOR DISPLAY APPARATUS AND DISPLAY APPARATUS USING THE SAME

(75) Inventors: Shunji Mikaki, Sendai (JP); Kazuyoshi Togo, Sendai (JP); Naoya Yoneda, Sendai (JP)

(73) Assignee: Kyocera Corporation, Kyoto (JP)

( * ) Notice: Subject to any disclaimer, the term of this patent is extended or adjusted under 35 U.S.C. 154(b) by 203 days.

(21) Appl. No.: 10/463,228

(22) Filed: Jun. 17, 2003

(65) Prior Publication Data

US 2004/0036408 A1 Feb. 26, 2004

(30) Foreign Application Priority Data

Jun. 18, 2002 (JP) ..... 2002-177390
Aug. 26, 2002 (JP) ..... 2002-245335

(51) Int. Cl.[7] ..... H01J 1/62; H01J 63/04; H01J 17/49; H01J 17/02; H01J 61/02

(52) U.S. Cl. ..... 313/495; 313/292; 313/512; 313/582; 313/586; 313/609; 313/610; 313/612

(58) Field of Search ..... 313/292, 495, 313/512, 582, 586, 609, 610, 612

(56) References Cited

U.S. PATENT DOCUMENTS 5,906,527 A * 5/1999 Shaikh et al. ..... 445/24
2003/0141803 A1 * 7/2003 Fushimi ..... 313/495

FOREIGN PATENT DOCUMENTS

| | | |
|---|---|---|
| JP | 2000-095559 | 4/2000 |
| JP | 2001-184624 | 7/2001 |
| JP | 2001-261365 | 9/2001 |

* cited by examiner

*Primary Examiner*—Mariceli Santiago
*Assistant Examiner*—Matt Hodges
(74) *Attorney, Agent, or Firm*—Hogan & Hartson, LLP

(57) ABSTRACT

Disclosed is a member for display apparatus used in a display apparatus comprising a back panel 1 on which electron sources are provided and a front panel 2 that are disposed to oppose the back panel 1 via spacers 3, said member comprising a ceramic that has a Young's modulus (E) of not lower than 120 GPa, a specific rigidity (E/ρ) of not lower than $40\times10^{9}$ cm, a coefficient of linear expansion of $7.5\times10^{-6}$ to $10\times10^{-6}$/° C. in a temperature range from ordinary temperature to 400° C., and a void-occupying area ratio of 6% or less. This member allows it to prevent the accuracy of the apparatus from lowering and cracks from occurring.

14 Claims, 1 Drawing Sheet

BACK PANEL AND/OR SPACER FOR DISPLAY APPARATUS AND DISPLAY APPARATUS USING THE SAME

BACKGROUND OF THE INVENTION

1. Field of the Invention

The present invention relates to a member used in a display apparatus and a display apparatus using the member and, more particularly, to a member that is used as a back panel or a spacer of a display apparatus.

2. Description of Related Art

Display apparatuses such as plasma display panel (PDP), plasma arrayed liquid crystal display (PALC) and field emission display (FED) have been used as high resolution display apparatuses that emit light by stimulating a fluorescent bodies with electron beams or ultraviolet rays in a gas or vacuum.

The field emission display (hereinafter referred to as FED), for example, comprises a back panel 1 provided with an electron source, and a front panel 2 that is disposed to oppose the back panel 1 via spacer 3 and a side wall 4 as shown in FIG. 1, wherein the electron source that functions as a cathode 1*a* is provided on the back panel 1 and an anode such as fluorescent bodies 2*a* is provided on the front panel 2, so that electron beam emitted by the cathode hits the fluorescent bodies, thus causing the fluorescent bodies to emit light so as to form a picture.

The back panel 1 and the spacer 3 of the FED are formed from glass by applying the technique to form a glass-made vacuum tube used in a cathode ray tube display (hereinafter referred to as CRT) or the substrate of a liquid crystal display (hereinafter abbreviated to LCD) that function by a principle of light emission similar to that of the FED.

As a material to make the back panel 1 and the spacer 3, Japanese Unexamined Patent Publication (Kokai) No. 2001-261365 discloses a glass for substrates comprising 10 to 50 mol % of $Al_2O_3$, 20 to 70 mol % of CaO, 25 mol % or less of $SiO_2$, MgO, SrO, BaO, ZnO, $TiO_2$, $Y_2O_3$ and $La_2O_3$, and 15 mol % or less of $ZrO_2$, $Li_2O$, $Na_2O$ and $K_2O$. This glass has a Young's modulus in a range from 83 to 124 GPa, a specific rigidity in a range from $33.4\times10^9$ to $38.6\times10^9$ cm and a linear expansion coefficient in a range from $8.4\times10^{-6}$ to $9.7\times10^{-6}$/°C. in a temperature range from 50 to 350° C.

Japanese Unexamined Patent Publication (Kokai) No. 2001-184624 discloses one having higher mechanical strength and comprising glass ceramic that contains lithium disilicide ($Li_2O$-$2SiO_2$) as the principal crystal phase and contains 4 to 8% by weight of $Li_2O$ on oxide basis, a material showing Young's modulus in a range from 95 to 120 GPa, a specific rigidity in a range from $39.4\times10^9$ to $47.1\times10^9$ cm and a linear expansion coefficient in a range from $6.5\times10^{-6}$ to $13.0\times10^{-6}$/° C. in a temperature range from −50 to 70° C.

Japanese Unexamined Patent Publication (Kokai) No. 2000-95559 discloses a composite glass ceramic material having higher Young's modulus and higher thermal conductivity with composition of 40 to 95% by weight of glass ceramic comprising 50 to 62% by weight of $SiO_2$, 5 to 10% by weight of $P_2O_5$, 22 to 26% by weight of $Al_2O_3$, 3 to 5% by weight of $Li_2O$, 0.6 to 2% by weight of MgO, 0.5 to 2% by weight of ZnO, 0.3 to 4% by weight of CaO, 0.5 to 4% by weight of BaO, 1 to 4% by weight of $TiO_2$, 1 to 4% by weight of $ZrO_2$ and 0 to 2% by weight of $As_2O_3$, and including a solid solution of β-quartz as crystal phase, and 5 to 60% by weight of filler that contains carbide, the material showing a Young's modulus in a range from 122 to 195 GPa, a linear expansion coefficient in a range from 0.3 to $5.0\times10^{-6}$/° C. in a temperature range from 50 to 360° C. and a heat conductivity in a range from 2.8 to 11.6 W/m·K.

Recently there have been increasing demands for thinner and larger displays. The display member disclosed in Japanese Unexamined Patent Publication (Kokai) No. 2001-261365 has a somewhat high Young's modulus, but has a low specific rigidity in a range from $33.4\times10^9$ to $38.6\times10^9$ cm. The member disclosed in Japanese Unexamined Patent Publication (Kokai) No. 2001-184624 has a low value of Young's modulus in a range from 95 to 120 GPa, that may cause deflection due to gravity or external force when used as the back panel 1 or the spacer 3.

That is, there is such a problem that, when bonding the back panel 1, the front panel 2, the spacer 3 and the side wall 4 together, the inner space of the display must be pumped to generate vacuum of $0.133\times10^{-3}$ Pa or higher, upon which the member may not withstand the atmospheric pressure.

The FED, on the other hand, uses a plurality of electron sources as small as 1 μm or less to cause a single pixel to illuminate. As a result, the display apparatus as a whole uses a significantly large number of electron sources that become heat sources when thermal electron emission is employed similarly to the CRT wherein filaments are heated to emit electrons, thus making it difficult to cool the apparatus.

To avoid the problem described above, an electron source (called the cold cathode) that employs field electron emission is used instead of thermal electron emission. Even in this case, there has been such a problem that thermal spots may be generated depending on the position in the apparatus resulting in deterioration of picture quality, since glass has very low heat conductivity of 3 W/m·K or less.

Moreover, while the FED requires a higher surface accuracy of the back panel 1 whereon the cathodes are mounted to serve as the electron sources, high accuracy of processing cannot be achieved because the conventional glass has a low Young's modulus.

The ceramic material disclosed in Japanese Pant Unexamined Publication No. 2000-95559 has a high Young's modulus but has a low linear expansion coefficient in a range from 0.3 to $5.0\times10^{-6}$/° C. that leads to such a problem that leakage may be caused resulting in lower vacuum inside of the apparatus due to crack caused in a joint when bonding the members, or low accuracy of the apparatus due to deflection, both resulting in lower picture quality.

Moreover, the back panel 1 and the spacer 3 are required to be made of a material that is not a complete insulator but has a certain level of electrical conductivity, since the spacer 3 may be charged and the FED may become unable to function when the volume resistivity is too high. However, in the prior art, glass made to have electrical conductivity tends to experience a decrease in Young's modulus, a decrease in specific rigidity and a decrease in heat conductivity and/or variation in the coefficient of linear expansion depending on the concentrations of the additive components.

SUMMARY OF THE INVENTION

An object of the present invention is to provide a member for display apparatus that allow it to prevent the accuracy of the apparatus from lowering and cracks from occurring.

Another object of the present invention is to provide a member for display apparatus that has a proper level of electrical conductivity while maintaining high Young's modulus, high specific rigidity and a proper value of linear expansion coefficient.

Still another object of the present invention is to provide a display apparatus that is capable of effectively preventing picture quality deterioration and, defects from occurring.

(1) To achieve the present invention, a member for display apparatus of the present invention used in a display apparatus comprising a back panel on which electron sources are provided and a front panel that are disposed to oppose each other via spacers, comprises a ceramic that has a Young's modulus (E) of not lower than 120 GPa, a specific rigidity (E/ρ) of not lower than $40\times10^9$ cm, a coefficient of linear expansion of $7.5\times10^{-6}$ to $10\times10^{-6}$/° C. from ordinary temperature to 400° C., and a void-occupying area ratio of 6% or less.

The specific rigidity (E/ρ) is defined as the value which restricts modification of material, i.e. easiness of bending, which is obtained by dividing Young's modulus by density.

(2) Preferably, the member for display apparatus of the present invention has, in addition to the characteristics according to (1), a volume resistivity in a range from $1\times10^5$ to $1\times10^{12}$ Ω·m in a temperature range from −40 to 60° C. and a temperature coefficient of a volume resistivity in a range from −5 to 5%/° C.

More specifically, the member for display apparatus according to (1) and (2) is preferably constituted as follows.

(3) The member for display apparatus comprises the ceramic that contains 40 to 90% by weight of at least one selected from alumina, forsterite and steatite, and 10 to 60% by weight of a component represented by the general formula $ABO_3$ (A represents an element selected from Mg, Ca, Sr and Ba, and B represents an element selected from Ti, Si and Sn).

(4) The member for display apparatus according to (3), comprises the ceramic that contains 30 parts by weight or less additive components based on 100 parts by weight of the sum total of at least one selected from alumina, forsterite and steatite and the component represented by the general formula $ABO_3$, and the additive components comprise 15 to 90% by weight of manganese dioxide, 3 to 40% by weight of an oxide of a group 5*a* element in periodic table, and 5 to 80% by weight of an oxide of an iron group element.

(5) The member for display apparatus according to (3) or (4), wherein the ceramic contains 40 to 90% by weight of alumina, while the element represented by A in the general formula is Ca and the element represented by B is Ti.

(6) The member for display apparatus comprises the ceramic that contains 40 to 90% by weight of at least one selected from alumina, forsterite and steatite, and 10 to 60% by weight of component represented by the general formula $MO_2$ (M represents an element selected from Ti, Si, Sn and Pb).

(7) The member for display apparatus according to (6), comprises the ceramic that contains 30 parts by weight or less additive components based on 100 parts by weight of the sum total of at least one selected from alumina, forsterite and steatite and the component represented by the general formula $MO_2$, and the additive components comprise 15 to 90% by weight of manganese dioxide, 3 to 40% by weight of an oxide of group 5*a* element in periodic table and 5 to 80% by weight of an oxide of iron group element.

(8) The member for display apparatus comprises the ceramic that contains 40 to 90% by weight of at least one selected from alumina, forsterite and steatite, and 10 to 60% by weight of component represented by the general formula XO (X represents an element selected from Mg, Ca, Sr and Ba).

(9) The member for display apparatus according to (8), comprises the ceramic that contains 30 parts by weight or less additive components based on 100 parts by weight of the sum total of at least one selected from alumina, forsterite and steatite and the component represented by the general formula XO, and the additive components comprise 15 to 90% by weight of manganese dioxide, 3 to 40% by weight of an oxide of group 5*a* element in periodic table and 5 to 80% by weight of an oxide of an iron group element.

(10) The member for display apparatus comprises the ceramic that contains 25 to 55% by weight of zirconia with the balance being alumina and titanium carbide, wherein a proportion of alumina is from 72 to 93% by weight and that of titanium carbide is 7 to 28 by weight based on 100% by weight of the sum total of alumina and titanium carbide.

In the constitutions of (3) to (8), alumina is preferable among alumina, forsterite and steatite. Among the general formulae of $ABO_3$, $MO_2$ and XO, $ABO_3$ (especially $CaTiO_3$) is preferable because of capability to maintain high Young's modulus and a low void-occupying area ratio. When steatite or forsterite is used, since it has low Young's modulus, $ABO_3$ (especially $CaTiO_3$) is preferable because of capability to maintain high Young's modulus. Materials represented by $MO_2$ and XO have substantially the same characteristics.

(11) The display apparatus of the present invention comprises the member for display apparatus of any one of (1) to (10), especially (1), (2), (3) and (10). Thus it is made possible to provide as electron beam is obtained by field electron emission and an extent of insulating property that maintains the voltage between the cathode and the anode, thereby to effectively prevent deterioration of picture quality and defects.

Various objects and advantages of the present invention will become apparent in the course of the description which follows.

DESCRIPTION OF THE PREFERRED EMBODIMENT

Figure 1:
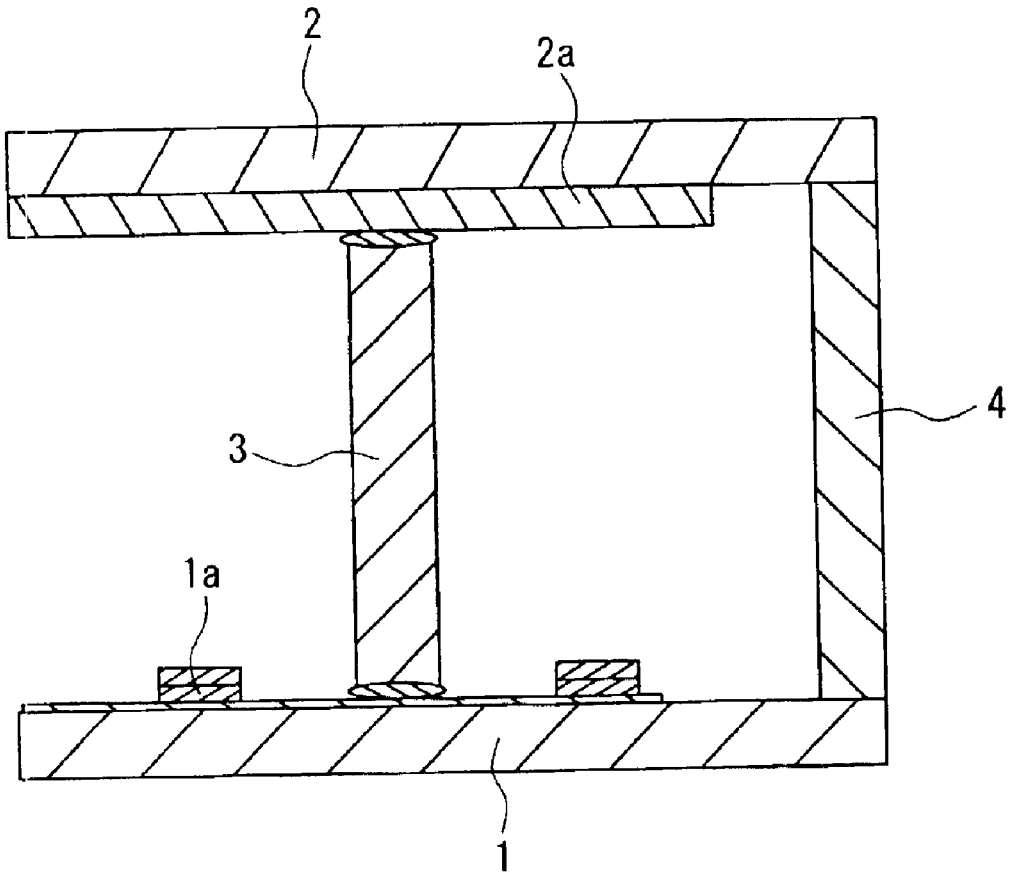
FIG. 1 is a sectional view showing an embodiment of the display apparatus of the present invention.

The member for display apparatus of the present invention will be described in detail below by way of example where the member for display apparatus is applied to a back panel 1 and/or a spacer 3 of FED as shown in FIG. 1.

The member for display apparatus of the present invention has Young's modulus (E) not lower than 120 GPa, and specific rigidity (E/ρ) not lower than $40\times10^9$ cm. Thus accuracy of the apparatus can be prevented from lowering due to deflection caused by impacts or other causes. As a result, satisfactory bonding can be achieved when forming the cathodes 1*a* on the back panel 1 and forming a high-resistivity film on the spacer 3.

The member for display apparatus of the present invention also has a coefficient of linear expansion in a range from $7.5\times10^{-6}$ to $9.7\times10^{-6}$/° C. in a temperature range from ordinary temperature to 400° C. Since this value is close to the linear expansion coefficient of bonding glass used for bonding the back panel 1 and the spacer 3 made of this material with the front panel 2, leakage of vacuum inside of the apparatus due to a crack caused in a joint and decrease in the accuracy of the apparatus due to deflection can be prevented, while effectively preventing the deterioration of picture quality and defects from occurring. Further according to the present invention, when the void-occupying area ratio is set to 6% or lower, preferably 2% or lower, removal of moisture and organic matter from the member can be done through heat treatment at a high temperature while suppressing the evolution of outgas.

The member for display apparatus of the present invention has a volume resistivity in a range from $1\times10^5$ to $1\times10^{12}$ Ω·m, preferably from $1\times10^8$ to $1\times10^{10}$ Ω·m in a temperature range from −40 to 60° C. and a temperature coefficient of volume resistivity of −5 to 5%/° C. which makes it possible to prevent accuracy of the apparatus from lowering due to deflection caused by impacts or other causes, and removal of moisture and organic matter from the member can be done through heat treatment at a high temperature while suppressing the evolution of outgas.

It is preferable that volume resistivity of the member for display apparatus used in a display apparatus of FED or the like is close to that of an insulating material, since the cathode 1*a* formed on the back panel 1 as the electron source cannot emit electron beam if the member has electrical conductivity. If volume resistivity of the spacer 3 is too low, electrical conductivity is generated between the cathode 1*a* formed on the back panel 1 and the fluorescent bodies 2*a* provided on the front panel 2, thus making it impossible to generate electron beam through field electron emission. Therefore, it is necessary for the spacer 3 to have such a degree of insulating property that maintains the voltage between the cathode 1*a* and the fluorescent bodies 2*a*, namely a high value of volume resistivity is necessary. When the volume resistivity is too high, on the other hand, the spacer 3 may be charged so as to make the FED unable to function, and therefore the spacer 3 is required to be made of a material that is not a complete insulator but has a certain level of electrical conductivity. Thus the back panel 1 and the spacer 3 are preferably made of materials that have a certain level of electrical conductivity, depending on such factors as the FED structure, the method of emitting electrons and the voltage applied between the cathode and the anode.

Such a member for display apparatus can be formed from ceramic that contains 40 to 90% by weight of at least one selected from alumina, forsterite and steatite, and 10 to 60% by weight of component represented by the general formula $ABO_3$ (A and B represent the materials mentioned previously).

With this constitution, volume resistivity of the member for display apparatus can be set to a value intermediate between those of an insulator and an electrical conductor. This constitution also causes a significant decrease in the range of variations of the volume resistivity due to the ceramic temperature. As a result, the member, that has the desired value of volume resistivity to provide a certain level of electrical conductivity depending on the method of emitting electrons in the display apparatus wherein the member is used and on the magnitude of voltage applied between the cathode and the anode, can be made to have a degree of insulating property that capable of emitting electrons from the electron source so as to obtain electron beam by field electron emission and maintains the voltage between the cathode and the anode.

Specifically, linear expansion coefficient can be set to a range from $7.5\times10^{-6}$ to $10\times10^{-6}$/° C. by making the back panel 1 and the spacer 3 from a material that contains 40 to 90% by weight of at least one selected from alumina, forsterite and steatite as the major component. Since this value of linear expansion coefficient is close to the linear expansion coefficient of bonding glass used for bonding the back panel 1 and the spacer 8 made of this material with the front panel 2, leakage of vacuum inside of the apparatus due to a crack caused in a joint and decrease in the accuracy of the apparatus due to deflection can be prevented, while effectively preventing the deterioration of picture quality and defects from occurring. When a low linear expansion coefficient is desired, only alumina or a material including higher content of alumina among alumina, forsterite and steatite may be used. When a high linear expansion coefficient is desired, only forsterite or only steatite or a material including higher content of forsterite or steatite may be used. Proportions of these components may be freely determined to the extent that the characteristic requirements of the present invention are satisfied.

Particularly in the case of ceramic that contains 40 to 90% by weight of alumina and 10 to 60% by weight of $CaTiO_3$ that is a special case of the general formula described above where the element represented by A is Ca and B is Ti, a member having higher strength and a desired value of volume resistivity to provide semi-conductive property can be obtained. Thus such a member for display apparatus can be made that has Young's modulus (E) of 200 GPa or higher, specific rigidity (E/ρ) of $60\times10^9$ cm or higher and a void-occupying area ratio of 2% or less. The ceramic described above also has volume resistivity of a value intermediate between those of an insulator and an electrical conductor or higher. This constitution also causes a significant decrease in the range of variations of the volume resistivity due to temperature changes. As a result, such a member can be made that an electron beam is obtained by field electron emission and has such a degree of insulating property that maintains the voltage between the cathode and the anode, so that a desired level of volume resistivity showing a certain level of electrical conductivity can be achieved according to the method of emitting electrons by the electron source of the display apparatus wherein the member is used and the magnitude of voltage applied between the cathode and the anode.

Similar effects can be achieved also when the materials represented by the general formula $MO_2$ or XO (M and X represent the same materials as those mentioned previously) instead of the general formula $ABO_3$.

When the content of at least one selected from alumina, forsterite and steatite is less than 40% by weight (namely the content of the material represented by the general formula $ABO_3$, $MO_2$ or XO is more than 60% by weight), linear expansion coefficient becomes $10\times10^{-6}$/° C. or higher, the void-occupying area ratio becomes 6% or higher, and temperature coefficient of volume resistivity becomes 5%/° C. or higher. When the content of at least one selected from alumina, forsterite and steatite is more than 90% by weight (namely the content of the material represented by the general formula $ABO_3$, $MO_2$ or XO is less than 10% by weight), since linear expansion coefficient becomes $7.5\times10^{-6}$/° C. or less, linear expansion coefficient of the back panel 1 and the spacer 3 becomes significantly different from that of the bonding glass that bonds the front panel 2, resulting in higher possibility of cracks occurring in the joint.

When the component represented by the general formula $ABO_3$ is contained, linear expansion coefficient of the material can be increased to a level similar to that of blue sheet glass used in the front panel 2 or the bonding glass by increasing the content the component. In case additive components to be described later are added, the void-occupying area ratio can be made lower than the case where the component represented by the general formula $ABO_3$ is not added.

According to the present invention, the member for display apparatus is preferably made of ceramic that contains 40 to 90% by weight of at least one selected from alumina, forsterite and steatite and 10 to 60% by weight of component represented by the general formulae $ABO_3$, $MO_2$ or XO as major components, wherein 30 parts by weight or less additive components is contained based on 100 parts by weight of the sum total of the major components. The additive components comprise 15 to 90% by weight of manganese dioxide, 3 to 40% by weight of oxide of at least one of group 5*a* elements in periodic table and 5 to 80% by weight of an oxide of at least one of iron group element The additive components described above function as electrical conductivity rendering agents and maintain Young's modulus, specific rigidity and heat conductivity at high levels so as to prevent cracks from being generated by impact, while rendering a certain level of electrical conductivity with volume resistivity in a range from $1\times10^5$ to $1\times10^{10}$ Ω·m in a temperature range from −40 to 60° C. and temperature coefficient of volume resistivity in a range from −5 to 5%/° C. in this temperature range.

Since content of the additive components is 30 parts by weight or less, a certain level of electrical conductivity is achieved with volume resistivity in a range from $1\times10^5$ to $1\times10^{10}$ Ω·m in a temperature range from −40 to 60° C. and temperature coefficient of volume resistivity of −5 to 5%/° C. in this temperature range, while maintaining Young's modulus at 120 GPa or higher, specific rigidity of $40\times10^9$ cm or higher and heat conductivity of 3 W/m·K or higher.

When content of the additive components is less than 5 parts by weight based on 100 parts by weight of the sum total of the major components, volume resistivity becomes higher than $1\times10^9$ Ω·m, and the material becomes more insulating. In case the material is used as an insulator, content of the additive components may be less than 5 parts by weight. When the material is used for the back panel 1 and the spacer 3 of FED, it is desired to be insulating or to have slight electrical conductivity.

Since the back panel 1 has cathodes 1*a* formed thereon as the electron sources, it is preferably an insulating material because electrical conductivity makes it impossible to emit electrons. If volume resistivity of the spacer 3 is too low, electrical conductivity is generated between the cathode 1*a* formed on the back panel 1 and the fluorescent bodies 2*a* provided on the front panel 2, making it impossible to generate electron beam through field electron emission. Therefore, it is necessary for the spacer 3 to have such an extent of insulating property that maintains the voltage between the cathode 1*a* and the fluorescent bodies 2*a*, namely a high value of volume resistivity. When the volume resistivity is too high, on the other hand, the spacer 3 may be charged so as to make the FED unable to function, and therefore the spacer 3 is required to be made of a material that is not a complete insulator but has a certain level of electrical conductivity. Thus such a constitution may be employed as the back panel 1 is made of a material having high volume resistivity by setting the content of the additive components to 5 parts by weight or less and volume resistivity of the spacer 3 is made lower than that of the back panel 1 so as to have slight electrical conductivity by setting the content of the additive components in the spacer in a range from 5 to 30 parts by weight.

Among the additive components described above, manganese dioxide is added to a concentration of 15 to 90% by weight, because this improves sintering performance to enable sintering at a relatively low temperature and makes it easier to obtain the desired value of volume resistivity. When content of manganese dioxide is more than 90% by weight, the material behaves more like an electrical conductor with volume resistivity decreasing to lower than $1\times10^5$ Ω·m, while the material becomes difficult to sinter when content of manganese dioxide is less than 15% by weight. Content of manganese dioxide is preferably in a range from 15 to 90% by weight in order to achieve volume resistivity in a range from $1\times10^5$ to $1\times10^{11}$ Ω·m, but is preferably from 30 to 90% by weight for the purpose of sintering.

The reason for including 3 to 40% by weight of an oxide of at least one of group 5*a* element in periodic table is the fact that temperature coefficient of volume resistivity becomes to 5%/° C. or higher when the content is less than 3% by weight, while the material behaves like an electrical conductor with volume resistivity being less than $1\times10^5$ Ω·m when the content is more than 40% by weight. The group 5*a* elements include vanadium, niobium and tantalum, among which niobium is preferable.

The reason for including 5 to 80% by weight of oxide of at least one of iron group element is the fact that temperature coefficient of volume resistivity separates from the range of −5 to 5%/° C. when the content is less than 5% by weight, while the material behaves like an electrical conductor with volume resistivity being less than $1\times10^5$ Ω·m when the content is more than 80%. The iron group elements include iron, cobalt and nickel, among which iron is preferable.

In order to obtain a ceramic material that has a certain level of electrical conductivity, in particular, it is most preferable that content of the additive components is from 15 to 20 parts by weight based on 100 parts by weight of the sum total of the major components, and the additive components contain 26 to 75% by weight of manganese dioxide, 27 to 80% by weight of iron oxide and 4 to 15% by weight of niobium oxide According to the present invention, another member for display apparatus used in forming the back panel 1 and the spacer 3 is ceramic that contains 25 to 55% by weight of zirconia with the balance being alumina and titanium carbide, while content of alumina is from 72 to 93% by weight and content of titanium carbide is from 7 to 28% by weight based on 100% by weight of the sum total of alumina and titanium carbide. This constitution enables it to maintain high values of Young's modulus, specific rigidity and heat conductivity, prevent cracks from occurring due to impact and provide a certain level of electrical conductivity with volume resistivity in a range from $1\times10^5$ to $1\times10^{12}$ Ω·m in a temperature range from −40 to 60° C. and temperature coefficient of volume resistivity of −5 to 5%/° C. in this temperature range.

Specifically, since use of zirconia, alumina and titanium carbide leads to a value of linear expansion coefficient in a range from $8\times10^{-6}$ to $9\times10^{-6}$/° C. that is close to the linear expansion coefficient of the bonding glass used for bonding the back panel 1 and the spacer 3 made of this material with the front panel 2, leakage of vacuum inside of the apparatus due to crack caused in a joint and decrease in the accuracy of the apparatus due to deflection can be prevented, while effectively preventing the deterioration of picture quality and defects from occurring.

Also because Young's modulus (E) of 300 GPa or higher, flexural strength of 500 MPa or higher and specific rigidity (E/ρ) of not lower than $60\times10^9$ cm can be achieved with this constitution, it is made possible to prevent the accuracy of the apparatus from decreasing due to deflection caused by impact and prevent the apparatus from being broken during handling operation, so that the yield of production can be greatly improved as the apparatus is manufactured with increasingly larger and thinner configuration. Also with the void-occupying area ratio being controlled to 2% or less, removal of moisture and organic matter from the member can be done through heat treatment at a high temperature while suppressing the evolution of outgas. Also it is made possible to decrease defects due to the voids when forming the cathodes 1*a* on the back panel 1 or forming a high-resistance film on the spacer 3.

A certain level of electrical conductivity can be achieved by setting volume resistivity in a range from $1\times10^5$ to $1\times10^{12}$ m in a temperature range from −40 to 60° C., and temperature coefficient of volume resistivity can be controlled from −5 to 5%/° C.

Moreover, since heat conductivity of 3 W/m·K or higher, or particularly 5 W/m·K or higher can be obtained, overheat of the fluorescent bodies 2*a* caused by impinging of electrons emitted by the cathodes 1*a* for image forming can be suppressed, thereby effectively preventing deterioration of picture quality and defects.

When content of alumina is less than 72% by weight (namely content of titanium carbide is more than 28% by weight), the ceramic approaches an electrical conductivity with volume resistivity becoming less than $1\times10^5$ Ω·m. When content of alumina is more than 93% by weight (namely content of titanium carbide is less than 7% by weight), volume resistivity becomes higher than $1\times10^{12}$ Ω·m. Therefore in the present invention, content of alumina is set in a range from 72 to 93% by weight and content of titanium carbide is set in a range from 7 to 28% by weight, so as to achieve a certain level of electrical conductivity in a range from $1\times10^5$ to $1\times10^{12}$ Ω·m.

Specifically, when content of zirconia is less than 25% by weight based on 100% by weight of the sum total of alumina and titanium carbide, linear expansion coefficient becomes $8\times10^{-6}$/° C. or lower. When content of zirconia is more than 55% by weight based on 100% by weight of the sum total of alumina and titanium carbide, linear expansion coefficient becomes $9\times10^{-6}$/° C. or higher. Therefore in the present invention, content of zirconia is set in a range from 25 to 55% by weight based on 100% by weight of the sum total of alumina and titanium carbide, so as to achieve linear expansion coefficient in a range from $8\times10^{-6}$ to $9\times10^{-6}$/° C.

While a binary system of alumina and titanium carbide has a high temperature coefficient of volume resistivity, addition of zirconia has an effect of stabilizing the temperature coefficient at a low level, thus enabling it to control the temperature coefficient of volume resistivity of the spacer 3 from −5 to 5%/° C. in a temperature range from −40 to 60° C.

A sample is prepared by grinding to 0.1 μm of arithmetic mean surface roughness (Ra), and apparent density is measured by the Archimedes method. Young's modulus is measured by ultrasonic pulse method (per JIS R1602). Specific rigidity (E/ρ) is determined by dividing Young's modulus by apparent density. Linear expansion coefficient is measured by the method of measuring thermal expansion (per JIS R1618) based on thermo-mechanical analysis of ceramic. Surface void occupancy ratio can be determined by electron microscope observation with 100 times magnifying power and calculation of the observed result. Heat conductivity is measured by laser flash method (per JIS R1611). Volume resistivity is measured in a temperature range from −40 to 60° C. by the method of measuring insulation resistance specified in JIS C2141, and the temperature coefficient of volume resistivity is calculated.

In order to form the back panel 1 and the spacer 3 from the ceramic material as described above, powder of such materials as alumina, forsterite, steatite, magnesium titanate, calcium titanate, barium titanate, strontium titanate, magnesium stannate, calcium stannate, barium stannate, strontium stannate, wallastonite, enstatite, titanium oxide, silicon oxide, tin oxide, lead oxide, magnesium oxide, calcium oxide, strontium oxide, barium oxide, manganese dioxide, oxide of group 5*a* element in periodic table or oxide of iron group element, or hydroxide or carbonate of these materials that can be turned into these materials during sintering process may be used. The materials are mixed and formed in a predetermined shape by a proper forming method, that is then fired at a temperature from 1250 to 1450° C. in oxidizing atmosphere for one to three hours.

Alternatively, alumina $Al_2O_3$ (purity 99.9%, mean particle size 0.4 μm) and titanium carbide TiC (purity 98.5%, mean particle size 0.7 μm) may be used as starting materials. 72 to 93% by weight of alumina and 7 to 28% by weight of titanium carbide are weighed, and 33 to 122% by weight of zirconia based on 100% by weight of the sum total of alumina and titanium carbide (namely, 25 to 55% by weight of zirconia based on 100% by weight of the sum total of zirconia, alumina and titanium carbide) is added thereto. With 6% by weight of sintering assisting agent being added based on 100% by weight of the sum total of alumina, titanium carbide and zirconia, the materials are mixed in a ball mill or the like and formed in a predetermined shape by a proper forming method, that is then fired at a temperature from 1600 to 1800° C. in non-oxidizing atmosphere for one to three hours.

The example of sintering assisting agent may be calcium oxide, magnesium oxide, chromium oxide, silica, yttrium oxide, ytterbium oxide or the like, of which content may be within 10% by weight or less based on 100% by weight of the sum total of alumina, titanium carbide and zirconia. Content of the sintering assisting agent is preferably in a range from 6 to 10% by weight in view of sintering performance, but is preferably from 4 to 6% by weight in view of the density of the sintered material.

While the powder materials may be mixed in a dry process, spray drying method is employed for granulation and forming the material when the materials are mixed in a wet process. When crushing and mixing the materials in a ball mill or the like, there may occur mixing of calcium oxide, magnesium oxide, chromium oxide, cobalt oxide, magnesium oxide, silica, manganese oxide, iron oxide, yttrium oxide, ytterbium oxide or the like coming from the ball, mixing of such substances does not cause a problem as long as the resultant composition remains within the range described above.

As the starting materials, alumina having particle sizes of 0.2 to 0.5 μm and titanium carbide having particle sizes of 0.3 to 1.0 μm that are crushed to particle sizes in a range from 0.4 to 0.6 μm are preferably used. In the prior art, alumina having particle sizes of 0.3 to 1.0 μm and titanium carbide having particle sizes of 1.0 to 3.0 μm have been used as the starting material that are crushed to particle sizes in a range from 0.4 to 0.6 μm, in which case it has been necessary to carry out mechanical crushing for a long period of time because of the relatively large particles. This results in particles having sharp edges and broader distribution of particle sizes, that may cause the sintered material to deform. This is supposedly because the particles having various shapes and sizes have varied surface energies and result in non-uniform sintering reaction. This results in locally different rates of sintering and therefore larger deformation of the sintered material.

By using alumina having particle sizes of 0.2 to 0.5 μm and titanium carbide having particle sizes of 0.3 to 1.0 μm as the starting materials, in contrast, deformation of the sintered material when making members such as the spacer 3 is suppressed, because the particles before sintering have less differences in the particle sizes and spherical shape.

FIG. 1 is a sectional view of an FED apparatus including the back panel 1 and the spacer 3 that are formed by using the member for display apparatus of the present invention. As shown in FIG. 1, the FED comprises the back panel 1 having the cathodes 1*a* to service as electron sources provided thereon and the front panel 2 that is disposed to oppose the back panel 1 via the spacer 3 and the side wall 4 and has anodes such as fluorescent bodies 2*a* provided thereon, wherein electron beam emitted by the cathode 1*a* hits the fluorescent bodies 2*a*, thus causing the fluorescent bodies 2*a* to emit light so as to form a picture.

In the FED described above, inside of the display apparatus enclosed by the back panel 1, the side wall 4 and the front panel 2 form an airtight chamber to maintain $0.133\times10^{-3}$ Pa or higher vacuum. As the screen size of the FED becomes larger, in order to prevent the back panel 1 and the front panel 2 from being deformed or broken by the pressure difference between the inside and outside of the airtight chamber, the spacer 3 is bonded between the back panel 1 and the front panel 2 with a glass bond in a high-temperature atmosphere of 400 to 500° C., thereby to prevent the airtight chamber from breaking due to the atmospheric pressure or impact.

The back panel 1, which has the plurality of cathodes 1*a* serving as the electron sources being formed on the surface thereof and serves as the substrate that support the front panel 2, the spacer 3 and the side wall 4, must have high rigidity. Surface area and thickness of the back panel 1 are determined by taking into consideration such factors as the number of electron sources formed on the surface thereof, screen size, strength, arrangement and number of the spacers 3 to be described later, weight of the display apparatus and safety factor.

The spacers 3 are formed on the back panel 1 at intervals of several tens to several hundreds of millimeters in order to maintain a predetermined distance between the back panel 1 and the front panel 2 that are disposed to oppose each other.

The fluorescent bodies 2*a* are formed from glass or the like having linear expansion coefficient in a range from $8\times10^{-6}$/° C. to $9\times10^{-6}$/° C. on the bottom surface of the front panel 2 that is disposed to oppose the back panel 1 via the spacer 3 and the side wall 4, namely on the surface that opposes the back panel 1.

The fluorescent bodies 2*a* are formed on the front panel 2 have three primary colors of red (R), green (G) and blue (B), with black portions (not shown) provided between the fluorescent bodies 2*a*. The spacers 3 are disposed in the black portions so as to be invisible from the outside of the display. As such, lateral dimension of the black portion is preferably as small as possible. It is important that lateral dimension of the spacers 3 is smaller than the lateral dimension of the black portion. As lateral dimension of the black portion is on the order of micrometers, the spacers 3 are required to have high accuracy and high rigidity. Length, thickness and number of the spacers 3 are determined by taking into consideration such factors as the types and numbers of the black portion and display, strength of the back panel 1 and the front panel 2, weight of the display apparatus and safety factor.

It is important that the back panel 1 and the spacers 3 are made of the member for display apparatus of the present invention described above, namely the ceramic that has Young's modulus (E) of 120 GPa or higher, specific rigidity (E/ρ) of $40\times10^{9}$ cm or higher, linear expansion coefficient in a range from $7.5\times10^{-6}$ to $10\times10^{-6}$/° C. in a temperature range from ordinary temperature to 400° C., and a void-occupying area ratio of 6% or less.

In the mode of embodying the present invention described above, the back panel 1 and the spacer 3 are formed from the member for display apparatus of the present invention, but the member for display apparatus of the present invention may be applied to either one of the members, or to a member other than the back panel 1 and the spacer 3, for example the side wall 4.

The following examples illustrate the manner in which the present invention can be practiced. It is understood, however, that the examples are for the purpose of illustration and the invention is not to be regarded as limited to any of the specific materials or condition therein.

EXAMPLE I

First, alumina powder, forsterite powder, steatite powder, magnesium titanate powder, calcium titanate powder, barium titanate powder, strontium titanate powder, magnesium stannate powder, calcium stannate powder, barium stannate powder, strontium stannate powder, wallastonite powder, enstatite powder, titanium oxide powder, silicon oxide powder, tin oxide powder, lead oxide powder, magnesium oxide powder, calcium oxide powder, strontium oxide powder and barium oxide powder, were prepared, together with manganese oxide powder, oxide powder of group 5*a* element in periodic table and oxide powder of iron group element as additive components. These powdery materials were weighed to such proportions corresponding to the composition of the ceramic shown in Tables 1 and 2, and were mixed in wet process in a rotary mill. Slurry of the mixture was spray-dried to make a material cake for sintering.

The material cake was formed into shape by pressing, and was sintered in air atmosphere at temperature shown in Tables 1 and 2, thereby making samples of spacer.

TABLE 1

| Sample No. | Composition: Alumina, forsterite or steatite and its amount (wt. %) | $ABO_3$, $MO_2$ or XO and its amount (wt. %) | Additive Components (pbw[1]) | Content of Additive Components: $MnO_2$ (wt. %) | Group 5a Element Kind | Group 5a Element (wt. %) | Oxide of Iron Element Kind | Oxide of Iron Element (wt. %) | Sintering Temperature (° C.) |
|---|---|---|---|---|---|---|---|---|---|
| I-1 | Alumina 90.0 | $BaTiO_3$ 10.0 | 0.0 | — | — | — | — | — | 1450 |
| I-2 | Alumina 85.0 | $BaTiO_3$ 15.0 | 0.0 | — | — | — | — | — | 1400 |
| I-3 | Alumina 80.0 | $BaTiO_3$ 20.0 | 0.0 | — | — | — | — | — | 1350 |
| I-4 | Alumina 60.0 | $BaTiO_3$ 40.0 | 0.0 | — | — | — | — | — | 1350 |
| I-5 | Alumina 40.0 | $BaTiO_3$ 60.0 | 0.0 | — | — | — | — | — | 1350 |
| I-6 | Alumina 45.0 | $BaTiO_3$ 55.0 | 0.0 | — | — | — | — | — | 1300 |
| I-7 | Alumina 90.0 | $BaTiO_3$ 10.0 | 5.0 | 40.0 | $Nb_2O_5$ | 10.0 | $Fe_2O_3$ | 50.0 | 1400 |
| I-8 | Alumina 40.0 | $BaTiO_3$ 60.0 | 5.0 | 40.0 | $Nb_2O_5$ | 10.0 | $Fe_2O_3$ | 50.0 | 1350 |
| * I-9 | Alumina 35.0 | $BaTiO_3$ 65.0 | 5.0 | 40.0 | $Nb_2O_5$ | 10.0 | $Fe_2O_3$ | 50.0 | 1325 |
| I-10 | Alumina 90.0 | $BaTiO_3$ 10.0 | 30.0 | 40.0 | $Nb_2O_5$ | 10.0 | $Fe_2O_3$ | 50.0 | 1400 |
| I-11 | Alumina 40.0 | $BaTiO_3$ 60.0 | 30.0 | 40.0 | $Nb_2O_5$ | 10.0 | $Fe_2O_3$ | 50.0 | 1350 |
| * I-12 | Alumina 35.0 | $BaTiO_3$ 65.0 | 30.0 | 40.0 | $Nb_2O_5$ | 10.0 | $Fe_2O_3$ | 50.0 | 1325 |
| I-13 | Alumina 90.0 | $SrTiO_3$ 10.0 | 0.0 | — | — | — | — | — | 1400 |
| I-14 | Alumina 40.0 | $SrTiO_3$ 60.0 | 0.0 | — | — | — | — | — | 1300 |
| I-15 | Alumina 45.0 | $SrTiO_3$ 55.0 | 0.0 | — | — | — | — | — | 1250 |
| I-16 | Alumina 90.0 | $SrTiO_3$ 10.0 | 5.0 | 40.0 | $Nb_2O_5$ | 10.0 | $Fe_2O_3$ | 50.0 | 1350 |
| I-17 | Alumina 40.0 | $SrTiO_3$ 60.0 | 5.0 | 40.0 | $Nb_2O_5$ | 10.0 | $Fe_2O_3$ | 50.0 | 1300 |
| * I-18 | Alumina 35.0 | $SrTiO_3$ 65.0 | 5.0 | 40.0 | $Nb_2O_5$ | 10.0 | $Fe_2O_3$ | 50.0 | 1275 |
| I-19 | Alumina 90.0 | $SrTiO_3$ 10.0 | 30.0 | 40.0 | $Nb_2O_5$ | 10.0 | $Fe_2O_3$ | 50.0 | 1350 |
| I-20 | Alumina 40.0 | $SrTiO_3$ 60.0 | 30.0 | 40.0 | $Nb_2O_5$ | 10.0 | $Fe_2O_3$ | 50.0 | 1300 |
| * I-21 | Alumina 35.0 | $SrTiO_3$ 65.0 | 30.0 | 40.0 | $Nb_2O_5$ | 10.0 | $Fe_2O_3$ | 50.0 | 1275 |
| I-22 | Alumina 90.0 | $MgTiO_3$ 10.0 | 0.0 | — | — | — | — | — | 1350 |
| I-23 | Alumina 40.0 | $MgTiO_3$ 60.0 | 0.0 | — | — | — | — | — | 1300 |
| I-24 | Alumina 45.0 | $MgTiO_3$ 55.0 | 0.0 | — | — | — | — | — | 1250 |
| I-25 | Alumina 90.0 | $MgSnO_3$ 10.0 | 0.0 | — | — | — | — | — | 1275 |
| I-26 | Alumina 40.0 | $MgSnO_3$ 60.0 | 0.0 | — | — | — | — | — | 1250 |
| * I-27 | Alumina 35.0 | $MgSnO_3$ 65.0 | 0.0 | — | — | — | — | — | 1250 |
| I-28 | Forsterite 90.0 | $BaTiO_3$ 10.0 | 0.0 | — | — | — | — | — | 1400 |
| I-29 | Forsterite 40.0 | $BaTiO_3$ 60.0 | 0.0 | — | — | — | — | — | 1300 |
| * I-30 | Forsterite 35.0 | $BaTiO_3$ 65.0 | 0.0 | — | — | — | — | — | 1250 |
| I-31 | Forsterite 90.0 | $BaTiO_3$ 10.0 | 5.0 | 40.0 | $Nb_2O_5$ | 10.0 | $Fe_2O_3$ | 50.0 | 1350 |
| I-32 | Forsterite 40.0 | $BaTiO_3$ 60.0 | 5.0 | 40.0 | $Nb_2O_5$ | 10.0 | $Fe_2O_3$ | 50.0 | 1300 |
| * I-33 | Forsterite 35.0 | $BaTiO_3$ 65.0 | 5.0 | 40.0 | $Nb_2O_5$ | 10.0 | $Fe_2O_3$ | 50.0 | 1275 |

Sample numbers marked with * are not within the scope of the present invention.
[1] "pbw" means "parts by weight".

TABLE 2

| Sample No. | Composition: Alumina, forsterite or steatite and its amount (wt. %) | $ABO_3$, $MO_2$ or XO and its amount (wt. %) | Additive Components (pbw[1]) | Content of Additive Components: $MnO_2$ (wt. %) | Group 5a Element Kind | Group 5a Element (wt. %) | Oxide of Iron Element Kind | Oxide of Iron Element (wt. %) | Sintering Temperature (° C.) |
|---|---|---|---|---|---|---|---|---|---|
| I-34 | Forsterite 90.0 | $BaTiO_3$ 10.0 | 30.0 | 40.0 | $Nb_2O_5$ | 10.0 | $Fe_2O_3$ | 50.0 | 1350 |
| I-35 | Forsterite 40.0 | $BaTiO_3$ 60.0 | 30.0 | 40.0 | $Nb_2O_5$ | 10.0 | $Fe_2O_3$ | 50.0 | 1300 |
| * I-36 | Forsterite 35.0 | $BaTiO_3$ 65.0 | 30.0 | 40.0 | $Nb_2O_5$ | 10.0 | $Fe_2O_3$ | 50.0 | 1275 |
| I-37 | Forsterite 90.0 | $CaSiO_3$ 10.0 | 0.0 | — | — | — | — | — | 1400 |
| I-38 | Forsterite 40.0 | $CaSiO_3$ 60.0 | 0.0 | — | — | — | — | — | 1300 |
| * I-39 | Forsterite 35.0 | $CaSiO_3$ 65.0 | 0.0 | — | — | — | — | — | 1250 |
| I-40 | Forsterite 90.0 | $CaSiO_3$ 10.0 | 5.0 | 40.0 | $Nb_2O_5$ | 10.0 | $Fe_2O_3$ | 50.0 | 1350 |
| I-41 | Forsterite 40.0 | $CaSiO_3$ 60.0 | 5.0 | 40.0 | $Nb_2O_5$ | 10.0 | $Fe_2O_3$ | 50.0 | 1300 |
| * I-42 | Forsterite 35.0 | $CaSiO_3$ 65.0 | 5.0 | 40.0 | $Nb_2O_5$ | 10.0 | $Fe_2O_3$ | 50.0 | 1275 |
| I-43 | Forsterite 90.0 | $CaSiO_3$ 10.0 | 30.0 | 40.0 | $Nb_2O_5$ | 10.0 | $Fe_2O_3$ | 50.0 | 1350 |
| I-44 | Forsterite 40.0 | $CaSiO_3$ 60.0 | 30.0 | 40.0 | $Nb_2O_5$ | 10.0 | $Fe_2O_3$ | 50.0 | 1300 |
| * I-45 | Forsterite 35.0 | $CaSiO_3$ 65.0 | 30.0 | 40.0 | $Nb_2O_5$ | 10.0 | $Fe_2O_3$ | 50.0 | 1275 |

TABLE 2-continued

| Sample No. | Composition: Alumina, forsterite or steatite and its amount (wt. %) | $ABO_3$, $MO_2$ or XO and its amount (wt. %) | Additive Components (pbw[1]) | Content of Additive Components: $MnO_2$ (wt. %) | Group 5a Element: Kind | Group 5a Element: (wt. %) | Oxide of Iron Element: Kind | Oxide of Iron Element: (wt. %) | Sintering Temperature (° C.) |
|---|---|---|---|---|---|---|---|---|---|
| I-46 | Steatite 90.0 | $BaTiO_3$ 10.0 | 0.0 | — | — | — | — | — | 1400 |
| I-47 | Steatite 40.0 | $BaTiO_3$ 60.0 | 0.0 | — | — | — | — | — | 1300 |
| I-48 | Steatite 45.0 | $BaTiO_3$ 55.0 | 0.0 | — | — | — | — | — | 1250 |
| I-49 | Steatite 90.0 | $BaTiO_3$ 10.0 | 5.0 | 40.0 | $Nb_2O_5$ | 10.0 | $Fe_2O_3$ | 50.0 | 1350 |
| I-50 | Steatite 40.0 | $BaTiO_3$ 60.0 | 5.0 | 40.0 | $Nb_2O_5$ | 10.0 | $Fe_2O_3$ | 50.0 | 1300 |
| * I-51 | Steatite 35.0 | $BaTiO_3$ 65.0 | 5.0 | 40.0 | $Nb_2O_5$ | 10.0 | $Fe_2O_3$ | 50.0 | 1275 |
| I-52 | Steatite 90.0 | $BaTiO_3$ 10.0 | 30.0 | 40.0 | $Nb_2O_5$ | 10.0 | $Fe_2O_3$ | 50.0 | 1350 |
| I-53 | Steatite 40.0 | $BaTiO_3$ 60.0 | 30.0 | 40.0 | $Nb_2O_5$ | 10.0 | $Fe_2O_3$ | 50.0 | 1300 |
| * I-54 | Steatite 35.0 | $BaTiO_3$ 65.0 | 30.0 | 40.0 | $Nb_2O_5$ | 10.0 | $Fe_2O_3$ | 50.0 | 1275 |
| I-55 | Alumina 60.0 + Forsterite 30.0 | $CaTiO_3$ 10.0 | 0.0 | — | — | — | — | — | 1425 |
| I-56 | Alumina 30.0 + Forsterite 60.0 | $CaTiO_3$ 10.0 | 0.0 | — | — | — | — | — | 1425 |
| I-57 | Alumina 60.0 + Steatite 30.0 | $CaTiO_3$ 10.0 | 0.0 | — | — | — | — | — | 1425 |
| I-58 | Alumina 30.0 + Steatite 60.0 | $CaTiO_3$ 10.0 | 0.0 | — | — | — | — | — | 1425 |
| I-59 | Alumina 60.0 + Forsterite 30.0 | $SnO_2$ 10.0 | 0.0 | — | — | — | — | — | 1400 |
| I-60 | Alumina 30.0 + Forsterite 60.0 | $SnO_2$ 10.0 | 0.0 | — | — | — | — | — | 1375 |
| I-61 | Alumina 60.0 + Steatite 30.0 | $PbO_2$ 10.0 | 0.0 | — | — | — | — | — | 1375 |
| I-62 | Alumina 30.0 + Steatite 60.0 | $PbO_2$ 10.0 | 0.0 | — | — | — | — | — | 1350 |
| I-63 | Alumina 90.0 | SrO 10.0 | 0.0 | — | — | — | — | — | 1400 |
| I-64 | Alumina 40.0 | SrO 60.0 | 0.0 | — | — | — | — | — | 1350 |
| * I-65 | Alumina 35.0 | SrO 65.0 | 0.0 | — | — | — | — | — | 1325 |

Sample numbers marked with * are not within the scope of the present invention.
[1]"pbw" means "parts by weight".

The samples of spacer were cut into prisms measuring 3 mm×4 mm×50 mm, that were polished to arithmetic mean surface roughness (Ra) of 0.1 μm, thereby making the test pieces. Apparent density of the test piece was measured by Archimedes method, Young's modulus was measured by ultrasonic pulse method (per JIS R1602), and then specific rigidity (E/ρ) was determined. Surface void occupancy ratio was determined through observation by means of LIZEX-FS manufactured by NIREKO Corporation with 100 times magnifying power and calculation of the observed result.

Linear expansion coefficient at temperatures from ordinary temperatures to 400° C. were measured by the method of measuring thermal expansion coefficient (per JIS R1618) based on thermo-mechanical analysis of ceramic, by means of DL-1500-Y manufactured by ULVAC-RIKO, Inc.

Heat conductivity was measured by laser flash method (per JIS R1611) using another test piece that was cut into a disk shape of 10 mm in diameter and 2 mm in thickness.

Using another test piece that was cut into a disk shape of 60 mm in diameter and 2 mm in thickness, resistance was measured by the method of measuring insulation resistance specified in JIS C2141. Specifically, the test piece was put in vacuum of $0.133\times10^{-3}$ Pa, with terminals of a megger connected to both ends of the test piece. After leaving the test piece for 10 minutes after temperature of the inside of the vacuum chamber stabilized at each of −40° C., 20° C. and 60° C., voltage of 1000 V was applied to the test piece for five minutes and the reading of resistance was taken. Volume resistivity was calculated from the resistance, and the temperature coefficient of volume resistivity was determined. Volume resistivity was determined using the formula R=r×S/t (R is volume resistivity, r is resistance, S is surface area of electrode and t is thickness of the test piece) as specified in JIS C2141.

Temperature coefficient of volume resistivity TCR (%/° C.) was determined from TCR (%/° C.)=$[(R_{-40}-R_{60})/R_{25}/-100]\times100$, where $R_{-40}$ is volume resistivity at −40° C., $R_{25}$ is volume resistivity at 25° C., and $R_{60}$ is volume resistivity at 60° C.

Based on the results of measurements described above, the test piece was evaluated as ◎ when Young's modulus was 120 GPa or higher, specific rigidity was $40\times10^9$ cm or higher, linear expansion coefficient in a range from $7.5\times10^{-6}$ to $8.6\times10^{-6}$/° C., the void-occupying area ratio was 6% or less, heat conductivity was 3 W/m·K or higher, volume resistivity is in a range from $1\times10^8$ to $1\times10^{10}$ Ω·cm in a temperature range from −40 to 60° C., and temperature coefficient of volume resistivity was in a range from −4 to 0%/° C., and evaluated as ○ when Young's modulus was 120 GPa or higher, specific rigidity was $40\times10^9$ cm or higher, linear expansion coefficient was in a range from $7.5\times10^{-6}$ to $10\times10^{-6}$/° C., void-occupying surface area ratio was 6% or less, heat conductivity was 3 W/m·K or higher, volume resistivity was in a range from $1\times10^5$ to $1\times10^{12}$ Ω·cm in a temperature range from −40 to 60° C., and temperature coefficient of volume resistivity was in a range from −5 to 0%/° C. Results of evaluation are shown in Tables 3 and 4.

TABLE 3

| Sample No. | Apparent Density ρ (× $10^3$ kg/$m^3$) | Young's Modulus E (GPa) | Specific Rigidity E/ρ (cm) | Linner Expansion Coefficient (× $10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| I-1 | 4.0 | 369 | 92.0 | 7.5 | 2.0 | 34 | 8.4E+12 | 1.9E+11 | −2.74 | ○ |
| I-2 | 4.0 | 359 | 89.1 | 7.6 | 2.1 | 32 | 4.8E+12 | 9.7E+11 | −3.83 | ○ |
| I-3 | 4.1 | 348 | 85.7 | 7.8 | 2.3 | 30 | 7.3E+11 | 6.1E+10 | −3.35 | ○ |
| I-4 | 4.2 | 306 | 73.4 | 8.2 | 2.4 | 23 | 8.5E+10 | 9.7E+09 | −3.42 | ○ |
| I-5 | 4.3 | 264 | 61.7 | 8.7 | 2.8 | 16 | 4.1E+10 | 4.1E+09 | −3.73 | ○ |
| I-6 | 4.3 | 254 | 58.9 | 8.8 | 2.8 | 14 | 9.9E+09 | 9.0E+08 | −9.00 | ○ |
| I-7 | 4.3 | 235 | 54.7 | 7.5 | 2.6 | 7 | 4.8E+11 | 3.0E+10 | −1.36 | ○ |
| I-8 | 4.3 | 212 | 49.3 | 7.5 | 2.3 | 3 | 1.8E+10 | 6.0E+08 | −5.12 | ○ |
| * I-9 | 4.2 | 195 | 46.4 | 7.4 | — | — | — | — | — | — |
| I-10 | 4.0 | 220 | 55.0 | 7.5 | 4.3 | 7 | 5.0E+07 | 6.0E+06 | −4.40 | ◎ |
| I-11 | 3.9 | 209 | 53.6 | 7.5 | 5.8 | 3 | 9.0E+05 | 1.1E+05 | −4.39 | ◎ |
| * I-12 | 3.8 | 190 | 50.0 | 7.3 | — | — | — | — | — | — |
| I-13 | 4.0 | 371 | 93.2 | 7.5 | 3.2 | 34 | 7.7E+12 | 1.0E+11 | −2.35 | ○ |
| I-14 | 4.1 | 276 | 67.3 | 8.3 | 4.0 | 17 | 3.3E+11 | 2.9E+10 | −3.05 | ○ |
| I-15 | 4.1 | 267 | 65.0 | 8.4 | 4.4 | 16 | 9.7E+09 | 9.5E+08 | −8.75 | ○ |
| I-16 | 4.2 | 355 | 84.5 | 7.5 | 4.6 | 8 | 4.4E+11 | 3.2E+10 | −1.24 | ○ |
| I-17 | 4.2 | 265 | 63.1 | 7.9 | 3.8 | 4 | 1.5E+10 | 6.0E+08 | −4.24 | ○ |
| * I-18 | 4.1 | 255 | 62.2 | 7.3 | — | 2 | — | — | — | — |
| I-19 | 4.0 | 339 | 84.8 | 7.5 | 5.4 | 6 | 5.4E+07 | 7.2E+06 | −4.68 | ◎ |
| I-20 | 3.9 | 242 | 62.1 | 7.7 | 5.9 | 3 | 8.3E+05 | 1.3E+05 | −3.89 | ◎ |
| * I-21 | 3.8 | 229 | 60.3 | 7.2 | — | 2 | — | — | — | — |
| I-22 | 4.0 | 361 | 90.7 | 7.6 | 3.7 | 28 | 7.5E+12 | 1.2E+11 | −2.46 | ○ |
| I-23 | 4.1 | 267 | 65.1 | 8.4 | 4.3 | 9 | 3.1E+11 | 2.5E+10 | −2.88 | ○ |
| I-24 | 4.1 | 251 | 61.1 | 8.3 | 4.1 | 5 | 9.4E+09 | 9.3E+08 | −8.47 | ○ |
| I-25 | 4.1 | 310 | 75.6 | 7.6 | 3.7 | 18 | 7.5E+11 | 1.2E+10 | −2.46 | ○ |
| I-26 | 4.9 | 198 | 40.6 | 8.4 | 4.3 | 8 | 3.1E+10 | 2.5E+09 | −2.88 | ○ |
| * I-27 | 5.0 | 190 | 38.3 | — | — | — | — | — | — | — |
| I-28 | 3.4 | 153 | 44.7 | 9.9 | 3.0 | 5 | 7.9E+12 | 1.0E+11 | −2.60 | ○ |
| I-29 | 4.0 | 168 | 41.8 | 9.8 | 3.9 | 3 | 3.5E+11 | 2.9E+10 | −3.25 | ○ |
| * I-30 | 4.1 | 170 | 41.7 | 9.7 | 6.3 | — | — | — | — | — |
| I-31 | 3.7 | 152 | 41.1 | 7.5 | 4.5 | 4 | 4.3E+11 | 3.1E+10 | −1.21 | ○ |
| I-32 | 3.7 | 160 | 43.2 | 7.5 | 3.5 | 3 | 1.5E+10 | 6.1E+08 | −4.23 | ○ |
| * I-33 | 3.6 | 168 | 46.7 | 7.4 | — | — | — | — | — | — |

Sample numbers marked with * are not within the scope of the present invention.
Note:
In volume resistivity, for example, "8.4E+12" means 8.4 × $10^{12}$.

TABLE 4

| Sample No. | Apparent Density ρ (× $10^3$ kg/$m^3$) | Young's Modulus E (GPa) | Specific Rigidity E/ρ (cm) | Linner Expansion Coefficient (× $10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| I-34 | 3.3 | 150 | 45.5 | 7.5 | 5.3 | 3 | 5.6E+07 | 7.5E+06 | −4.85 | ◎ |
| I-35 | 3.2 | 155 | 48.4 | 7.5 | 5.8 | 3 | 8.6E+05 | 1.4E+05 | −4.00 | ◎ |
| * I-36 | 3.1 | 148 | 47.7 | 7.3 | — | — | — | — | — | — |
| I-37 | 3.2 | 145 | 45.6 | 9.9 | 3.4 | 5 | 8.9E+11 | 1.2E+10 | −2.93 | ○ |
| I-38 | 2.6 | 120 | 46.5 | 9.8 | 4.2 | 3 | 3.0E+10 | 3.9E+09 | −2.64 | ○ |
| * I-39 | 2.5 | 90 | 35.7 | — | — | — | — | — | — | — |
| I-40 | 3.5 | 142 | 40.6 | 7.5 | 4.6 | 4 | 4.1E+10 | 3.6E+09 | −1.13 | ◎ |
| I-41 | 2.6 | 125 | 48.1 | 7.5 | 3.9 | 3 | 1.6E+09 | 6.9E+07 | −4.50 | ◎ |
| * I-42 | 2.4 | 92 | 38.3 | — | — | — | — | — | — | — |
| I-43 | 3.3 | 140 | 42.4 | 7.5 | 5.5 | 3 | 5.0E+06 | 7.5E+05 | −4.25 | ◎ |
| I-44 | 2.8 | 124 | 44.3 | 7.5 | 5.8 | 3 | 8.0E+05 | 1.4E+05 | −3.67 | ◎ |
| * I-45 | 2.5 | 86 | 34.4 | — | — | — | — | — | — | — |
| I-46 | 3.2 | 145 | 46.0 | 8.6 | 3.9 | 5 | 7.0E+12 | 1.9E+11 | −2.27 | ○ |
| I-47 | 3.9 | 160 | 41.0 | 9.2 | 4.8 | 3 | 3.0E+11 | 1.9E+10 | −2.85 | ○ |
| I-48 | 4.0 | 163 | 41.0 | 8.2 | — | 2 | — | — | — | ○ |
| I-49 | 3.4 | 140 | 41.2 | 7.5 | 5.3 | 4 | 6.3E+11 | 2.3E+10 | −4.67 | ○ |
| I-50 | 3.6 | 152 | 42.2 | 8.0 | 4.5 | 3 | 1.5E+10 | 6.0E+08 | −4.24 | ○ |
| * I-51 | 3.5 | 148 | 42.3 | 7.0 | — | — | — | — | — | — |
| I-52 | 3.2 | 135 | 42.2 | 7.5 | 5.6 | 3 | 5.5E+07 | 7.1E+06 | −4.79 | ◎ |
| I-53 | 3.2 | 138 | 43.1 | 7.9 | 5.8 | 3 | 8.8E+05 | 1.0E+05 | −4.33 | ◎ |
| * I-54 | 3.1 | 132 | 42.6 | 6.9 | — | — | — | — | — | — |

TABLE 4-continued

| Sample No. | Apparent Density ρ ($\times 10^3$ kg/m$^3$) | Young's Modulus E (GPa) | Specific Rigidity E/ρ (cm) | Linner Expansion Coefficient ($\times 10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| I-55 | 3.7 | 280 | 75.7 | 7.8 | 3.0 | 10 | 8.3E+11 | 2.6E+10 | −2.68 | ○ |
| I-56 | 3.4 | 230 | 67.6 | 8.5 | 3.8 | 6 | 4.8E+11 | 9.6E+10 | −3.84 | ○ |
| I-57 | 3.5 | 265 | 75.7 | 7.5 | 3.5 | 8 | 8.0E+11 | 2.9E+10 | −2.57 | ○ |
| I-58 | 3.4 | 218 | 64.1 | 8.4 | 4.3 | 4 | 4.1E+11 | 9.2E+10 | −3.18 | ○ |
| I-59 | 4.0 | 230 | 57.5 | 7.6 | 3.0 | 15 | 8.3E+10 | 2.6E+09 | −2.68 | ○ |
| I-60 | 3.8 | 206 | 53.6 | 8.3 | 3.8 | 9 | 4.8E+10 | 9.6E+09 | −3.84 | ○ |
| I-61 | 3.9 | 198 | 50.8 | 7.8 | 3.5 | 8 | 8.0E+10 | 2.9E+09 | −2.57 | ○ |
| I-62 | 3.5 | 178 | 50.9 | 8.6 | 4.3 | 6 | 4.1E+10 | 9.2E+09 | −3.18 | ○ |
| I-63 | 3.8 | 280 | 73.7 | 7.6 | 3.8 | 15 | 8.8E+11 | 1.2E+10 | −3.95 | ○ |
| I-64 | 3.5 | 250 | 71.4 | 8.0 | 4.3 | 12 | 3.0E+10 | 3.8E+09 | −2.65 | ○ |
| * I-65 | 3.3 | 212 | 64.2 | 8.1 | 6.8 | — | — | — | — | — |

Sample numbers marked with * are not within the scope of the present invention.
Note:
In volume resistivity, for example, "8.4E+12" means $8.4 \times 10^{12}$.

As will be clear from Table 1 to Table 4, test pieces including 40 to 90% by weight of at least one selected from alumina, forsterite and steatite and 10 to 60% by weight of component represented by the general formulae $ABO_3$, $MO_2$ or XO, and test pieces including 15 to 90% by weight of manganese dioxide, 3 to 40% by weight of an oxide of group 5*a* element in periodic table and 5 to 80% by weight of oxide of iron group element as the additive components (Nos.I-1 to 8, 10, 11, 13 to 17, 19, 20, 22 to 26, 28, 29, 31, 32, 34, 35, 37, 38, 40, 41, 43, 44, 46 to 50, 52, 53, 55 to 64) showed high value of Young's modulus not less than 120 GPa, high specific rigidity (E/ρ) of $40\times10^9$ cm or higher, void-occupying area ratio of 6% or less and heat conductivity of 3 W/m·K or higher, thermal expansion coefficient in a range from $7.5\times10^{-6}$ to $10\times10^{-6}$/° C. at temperatures from ordinary temperatures to 400° C., volume resistivity in a range from $1\times10^5$ to $1\times10^{12}$ Ω·m in a temperature range from −40 to 60° C. and temperature coefficient of volume resistivity in a range from −5 to 5%/° C. in the temperature range from −40 to 60° C. Accordingly, these test pieces were rated as ⊙ or ○, and can be preferably used as the spacer and the back panel of FED.

Test pieces Nos.I-39, 42 and 45, in contrast, have Young's modulus not higher than 120 GPa, test pieces Nos.I-27, 39, 42 and 45 have specific rigidity (E/ρ) of $40\times10^9$ cm or less, test pieces Nos.I-9, 12, 18, 21, 33, 36, 51 and 54 do not have thermal expansion coefficient in a range from $7.5\times10^{-6}$ to $10\times10^{-6}$/° C. at temperatures from ordinary temperature to 400° C., and test pieces Nos.I-6, 15 and 24 have temperature coefficient of volume resistivity separated from a range from −5 to 5%/° C. in the temperature range from −40 to 60° C., thus failing to achieve the desired characteristics.

Materials of the prior art based on alumina powder have been fired in reducing atmosphere in order to obtain the desired level of resistivity, resulting in high manufacturing cost. The ceramic of the present invention, in contrast, is fired in air atmosphere and therefore a desired level of resistivity can be achieved at a lower cost.

EXAMPLE II

First, alumina powder, calcium titanate powder, manganese dioxide powder, oxide powder of group 5*a* element in periodic table or oxide powder of iron group element were prepared. These powdery materials were weighed to such proportions corresponding to the composition of the ceramic shown in Tables 5 and 6, and were mixed in wet process in a rotary mill. Slurry of the mixture was spray-dried to make a material cake for sintering.

The material cake was formed into shape by pressing, and was sintered in air atmosphere at temperature shown in Tables 5 and 6 for two hours, thereby making samples of spacer shown in FIG. 1.

Characteristics of four kinds of glass, test pieces Nos. II-69 to 72 will be described below as Comparative Examples. Test piece No. II-69 is glass consisting of 78% $SiO_2$, test piece No. II-70 is glass consisting of 71% $SiO_2$, test piece No. II-71 is glass consisting of 60% $SiO_2$, and test piece No. II-72 is glass consisting of 71% $SiO_2$ having electrical conductivity and high level of Young's modulus. Compositions of these test pieces are shown in Table 6.

TABLE 5

| Sample No. | Composition: $Al_2O_3$ (wt. %) | $CaTiO_3$ (wt. %) | Additive Components (pbw(1)) | $MnO_2$ (wt. %) | Content of Additive Components: Group 5a Element Kind | Group 5a Element (wt. %) | Oxide of Iron Element Kind | Oxide of Iron Element (wt. %) | Sintering Temperature (° C.) |
|---|---|---|---|---|---|---|---|---|---|
| * II-1 | 100.0 | 0.0 | 0.0 | — | — | — | — | — | 1450 |
| II-2 | 90.0 | 10.0 | 0.0 | — | — | — | — | — | 1450 |
| II-3 | 85.0 | 15.0 | 0.0 | — | — | — | — | — | 1400 |

TABLE 5-continued

| Sample No. | Composition: $Al_2O_3$ (wt. %) | $CaTiO_3$ (wt. %) | Additive Components (pbw[1]) | Content of Additive Components: $MnO_2$ (wt. %) | Group 5a Element: Kind | Group 5a Element: (wt. %) | Oxide of Iron Element: Kind | Oxide of Iron Element: (wt. %) | Sintering Temperature (° C.) |
|---|---|---|---|---|---|---|---|---|---|
| II-4 | 80.0 | 20.0 | 0.0 | — | — | — | — | — | 1350 |
| II-5 | 60.0 | 40.0 | 0.0 | — | — | — | — | — | 1350 |
| II-6 | 40.0 | 60.0 | 0.0 | — | — | — | — | — | 1350 |
| * II-7 | 35.0 | 65.0 | 0.0 | — | — | — | — | — | 1300 |
| * II-8 | 100.0 | 0.0 | 5.0 | 40.0 | $Nb_2O_5$ | 10.0 | $Fe_2O_3$ | 50.0 | 1400 |
| * II-9 | 100.0 | 0.0 | 15.0 | 40.0 | $Nb_2O_5$ | 10.0 | $Fe_2O_3$ | 50.0 | 1350 |
| * II-10 | 100.0 | 0.0 | 15.0 | — | $Nb_2O_5$ | 50.0 | $Fe_2O_3$ | 50.0 | 1350 |
| * II-11 | 100.0 | 0.0 | 25.0 | 40.0 | $Nb_2O_5$ | 10.0 | $Fe_2O_3$ | 50.0 | 1325 |
| * II-12 | 100.0 | 0.0 | 30.0 | 40.0 | $Nb_2O_5$ | 10.0 | $Fe_2O_3$ | 50.0 | 1325 |
| * II-13 | 100.0 | 0.0 | 35.0 | 40.0 | $Nb_2O_5$ | 10.0 | $Fe_2O_3$ | 50.0 | 1300 |
| II-14 | 90.0 | 10.0 | 5.0 | 40.0 | $Nb_2O_5$ | 10.0 | $Fe_2O_3$ | 50.0 | 1400 |
| II-15 | 80.0 | 20.0 | 5.0 | 40.0 | $Nb_2O_5$ | 10.0 | $Fe_2O_3$ | 50.0 | 1400 |
| II-16 | 60.0 | 40.0 | 5.0 | 40.0 | $Nb_2O_5$ | 10.0 | $Fe_2O_3$ | 50.0 | 1350 |
| II-17 | 40.0 | 60.0 | 5.0 | 40.0 | $Nb_2O_5$ | 10.0 | $Fe_2O_3$ | 50.0 | 1350 |
| * II-18 | 35.0 | 65.0 | 5.0 | 40.0 | $Nb_2O_5$ | 10.0 | $Fe_2O_3$ | 50.0 | 1325 |
| II-19 | 90.0 | 10.0 | 30.0 | 40.0 | $Nb_2O_5$ | 10.0 | $Fe_2O_3$ | 50.0 | 1400 |
| II-20 | 40.0 | 60.0 | 30.0 | 40.0 | $Nb_2O_5$ | 10.0 | $Fe_2O_3$ | 50.0 | 1350 |
| * II-21 | 35.0 | 65.0 | 30.0 | 40.0 | $Nb_2O_5$ | 10.0 | $Fe_2O_3$ | 50.0 | 1325 |
| * II-22 | 35.0 | 65.0 | 35.0 | 40.0 | $Nb_2O_5$ | 10.0 | $Fe_2O_3$ | 50.0 | 1300 |
| * II-23 | 100.0 | 0.0 | 25.0 | 53.0 | $Ta_2O_5$ | 40.0 | NiO | 7.0 | 1350 |
| II-24 | 40.0 | 60.0 | 25.0 | 53.0 | $Ta_2O_5$ | 40.0 | NiO | 7.0 | 1350 |
| * II-25 | 35.0 | 65.0 | 25.0 | 53.0 | $Ta_2O_5$ | 40.0 | NiO | 7.0 | 1300 |
| * II-26 | 100.0 | 0.0 | 25.0 | 49.5 | $Ta_2O_5$ | 45.0 | NiO | 5.5 | 1350 |
| * II-27 | 40.0 | 60.0 | 25.0 | 49.5 | $Ta_2O_5$ | 45.0 | NiO | 5.5 | 1350 |
| * II-28 | 35.0 | 65.0 | 25.0 | 49.5 | $Ta_2O_5$ | 45.0 | NiO | 5.5 | 1300 |
| * II-29 | 100.0 | 0.0 | 20.0 | 90.0 | $V_2O_5$ | 3.0 | CoO | 7.0 | 1350 |
| II-30 | 40.0 | 60.0 | 20.0 | 90.0 | $V_2O_5$ | 3.0 | CoO | 7.0 | 1350 |
| * II-31 | 35.0 | 65.0 | 20.0 | 90.0 | $V_2O_5$ | 3.0 | CoO | 7.0 | 1300 |
| * II-32 | 100.0 | 0.0 | 20.0 | 90.0 | $Nb_2O_5$ | — | CoO | 10.0 | 1350 |
| * II-33 | 100.0 | 0.0 | 15.0 | 17.0 | $Nb_2O_5$ | 3.0 | $Fe_2O_3$ | 80.0 | 1350 |
| II-34 | 40.0 | 60.0 | 15.0 | 17.0 | $Nb_2O_5$ | 3.0 | $Fe_2O_3$ | 80.0 | 1350 |
| * II-35 | 35.0 | 65.0 | 15.0 | 17.0 | $Nb_2O_5$ | 3.0 | $Fe_2O_3$ | 80.0 | 1325 |
| * II-36 | 100.0 | 0.0 | 15.0 | 12.0 | $Nb_2O_5$ | 3.0 | $Fe_2O_3$ | 85.0 | 1375 |

Sample numbers marked with * are not within the scope of the present invention.
[1]"pbw" means "parts by weight".

TABLE 6

| Sample No. | Composition: $Al_2O_3$ (wt. %) | $CaTiO_3$ (wt. %) | Additive Components (pbw[1]) | Content of Additive Components: $MnO_2$ (wt. %) | Group 5a Element: Kind | Group 5a Element: (wt. %) | Oxide of Iron Element: Kind | Oxide of Iron Element: (wt. %) | Sintering Temperature (° C.) |
|---|---|---|---|---|---|---|---|---|---|
| * II-37 | 40.0 | 60.0 | 15.0 | 12.0 | $Nb_2O_5$ | 3.0 | $Fe_2O_3$ | 85.0 | 1375 |
| * II-38 | 35.0 | 65.0 | 15.0 | 12.0 | $Nb_2O_5$ | 3.0 | $Fe_2O_3$ | 85.0 | 1350 |
| * II-39 | 100.0 | 0.0 | 15.0 | 15.0 | $Ta_2O_5$ | 40.0 | $Fe_2O_3$ | 45.0 | 1350 |
| II-40 | 40.0 | 60.0 | 15.0 | 15.0 | $Ta_2O_5$ | 40.0 | $Fe_2O_3$ | 45.0 | 1350 |
| * II-41 | 35.0 | 65.0 | 15.0 | 15.0 | $Ta_2O_5$ | 40.0 | $Fe_2O_3$ | 45.0 | 1325 |
| * II-42 | 100.0 | 0.0 | 15.0 | 13.0 | $Ta_2O_5$ | 40.0 | $Fe_2O_3$ | 47.0 | 1375 |
| * II-43 | 40.0 | 60.0 | 15.0 | 13.0 | $Ta_2O_5$ | 40.0 | $Fe_2O_3$ | 47.0 | 1375 |
| * II-44 | 35.0 | 65.0 | 15.0 | 13.0 | $Ta_2O_5$ | 40.0 | $Fe_2O_3$ | 47.0 | 1350 |
| * II-45 | 100.0 | 0.0 | 10.0 | 75.0 | $V_2O_5$ | 20.0 | CoO | 5.0 | 1375 |
| II-46 | 40.0 | 60.0 | 10.0 | 75.0 | $V_2O_5$ | 20.0 | CoO | 5.0 | 1350 |
| * II-47 | 35.0 | 65.0 | 10.0 | 75.0 | $V_2O_5$ | 20.0 | CoO | 5.0 | 1325 |
| * II-48 | 100.0 | 0.0 | 10.0 | 78.0 | $V_2O_5$ | 21.0 | CoO | 1.0 | 1375 |
| II-49 | 40.0 | 60.0 | 10.0 | 78.0 | $V_2O_5$ | 21.0 | CoO | 1.0 | 1350 |
| * II-50 | 35.0 | 65.0 | 10.0 | 78.0 | $V_2O_5$ | 21.0 | CoO | 1.0 | 1325 |
| * II-51 | 100.0 | 0.0 | 20.0 | 87.0 | $V_2O_5$ | 4.0 | NiO | 9.0 | 1350 |
| II-52 | 40.0 | 60.0 | 20.0 | 87.0 | $V_2O_5$ | 4.0 | NiO | 9.0 | 1325 |
| * II-53 | 35.0 | 65.0 | 20.0 | 87.0 | $V_2O_5$ | 4.0 | NiO | 9.0 | 1300 |
| * II-54 | 100.0 | 0.0 | 20.0 | 92.0 | $V_2O_5$ | 3.0 | NiO | 5.0 | 1350 |
| * II-55 | 40.0 | 60.0 | 20.0 | 92.0 | $V_2O_5$ | 3.0 | NiO | 5.0 | 1325 |
| * II-56 | 35.0 | 65.0 | 20.0 | 92.0 | $V_2O_5$ | 3.0 | NiO | 5.0 | 1300 |

TABLE 6-continued

| Sample No. | Composition: $Al_2O_3$ (wt. %) | $CaTiO_3$ (wt. %) | Additive Components (pbw[1]) | Content of Additive Components: $MnO_2$ (wt. %) | Group 5a Element Kind | Group 5a Element (wt. %) | Oxide of Iron Element Kind | Oxide of Iron Element (wt. %) | Sintering Temperature (° C.) |
|---|---|---|---|---|---|---|---|---|---|
| * II-57 | 100.0 | 0.0 | 17.0 | 26.0 | $Ta_2O_5$ | 30.0 | CoO | 44.0 | 1350 |
| II-58 | 40.0 | 60.0 | 17.0 | 26.0 | $Ta_2O_5$ | 30.0 | CoO | 44.0 | 1325 |
| * II-59 | 35.0 | 65.0 | 17.0 | 26.0 | $Ta_2O_5$ | 30.0 | CoO | 44.0 | 1300 |
| * II-60 | 100.0 | 0.0 | 13.0 | 31.0 | $Nb_2O_5$ | 23.0 | NiO | 46.0 | 1350 |
| II-61 | 40.0 | 60.0 | 13.0 | 31.0 | $Nb_2O_5$ | 23.0 | NiO | 46.0 | 1325 |
| * II-62 | 35.0 | 65.0 | 13.0 | 31.0 | $Nb_2O_5$ | 23.0 | NiO | 46.0 | 1300 |
| * II-63 | 100.0 | 0.0 | 10.0 | 31.0 | $Nb_2O_5$ | 15.5 | CoO | 53.5 | 1375 |
| II-64 | 40.0 | 60.0 | 10.0 | 31.0 | $Nb_2O_5$ | 15.5 | CoO | 53.5 | 1350 |
| * II-65 | 35.0 | 65.0 | 10.0 | 31.0 | $Nb_2O_5$ | 15.5 | CoO | 53.5 | 1325 |
| * II-66 | 100.0 | 0.0 | 20.0 | 40.0 | $Nb_2O_5$ | 33.0 | $Fe_2O_3$ | 27.0 | 1350 |
| II-67 | 40.0 | 60.0 | 20.0 | 40.0 | $Nb_2O_5$ | 33.0 | $Fe_2O_3$ | 27.0 | 1325 |
| * II-68 | 35.0 | 65.0 | 20.0 | 40.0 | $Nb_2O_5$ | 33.0 | $Fe_2O_3$ | 27.0 | 1300 |
| ** II-69 | $SiO_2$ purity 78% Glass | | | | | | | | |
| ** II-70 | $SiO_2$ purity 71% Glass | | | | | | | | |
| ** II-71 | $SiO_2$ purity 60% Glass | | | | | | | | |
| ** II-72 | $SiO_2$ purity 78% Conductive Glass | | | | | | | | |

Sample numbers marked with * are not within the scope of the present invention.
Mark ** denotes a comparative sample.
[1]"pbw" means "parts by weight".

Similarly to Example I, characteristics of the test pieces of spacer were measured.

Based on the results of measurements described above, the test piece was evaluated as ◎ when Young's modulus was 250 GPa or higher, linear expansion coefficient was in a range from $7.5\times10^{-6}$ to $8.6\times10^{-6}$/° C., heat conductivity was 3 W/m·K or higher and temperature coefficient of volume resistivity was within −3.5 to 3.5%/° C., and evaluated as ○ when Young's modulus was 200 GPa or higher, linear expansion coefficient was in a range from $7.5\times10^{-6}$ to $10\times10^{-6}$/° C., heat conductivity was 3 W/m·K or higher, and temperature coefficient of volume resistivity was within −5 to 5%/° C. Results of evaluation are shown in Tables 7 and 8.

TABLE 7

| Sample No. | Apparent Density ρ (× $10^3$ kg/m$^3$) | Young's Modulus E (GPa) | Specific Rigidity E/ρ (cm) | Linner Expansion Coefficient (× $10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| * II-1 | 3.9 | 380 | 97.4 | 7.3 | — | 34 | 6.1E+13 | 1.0E+13 | −2.55 | — |
| II-2 | 3.9 | 370 | 94.9 | 7.7 | 1.0 | 20 | 8.0E+12 | 2.0E+11 | −2.60 | ◎ |
| II-3 | 3.9 | 366 | 93.8 | 7.9 | 1.1 | 18 | 4.3E+12 | 9.9E+11 | −3.31 | ◎ |
| II-4 | 3.9 | 354 | 90.8 | 8.0 | 1.2 | 17 | 7.1E+11 | 6.5E+10 | −3.22 | ◎ |
| II-5 | 3.9 | 344 | 88.2 | 9.0 | 1.1 | 12 | 8.7E+10 | 9.9E+09 | −3.35 | ○ |
| II-6 | 3.8 | 320 | 84.2 | 9.8 | 1.3 | 8 | 4.7E+10 | 6.1E+09 | −4.13 | ○ |
| * II-7 | 3.9 | 281 | 72.1 | 10.2 | — | 6 | 9.9E+09 | 9.6E+08 | −8.94 | — |
| * II-8 | 3.9 | 367 | 94.1 | 7.2 | 17 | 12 | — | — | — | — |
| * II-9 | 3.5 | 252 | 72.0 | 7.0 | 21 | 8 | — | — | — | — |
| * II-10 | Not sintered | | | | | | | | | |
| * II-11 | 3.4 | 226 | 66.5 | 6.8 | — | 7 | — | — | — | — |
| * II-12 | 3.4 | 200 | 58.8 | 6.7 | — | 5 | — | — | — | — |
| * II-13 | 3.3 | 196 | 59.4 | 6.5 | — | 5 | 1.0E+05 | 3.2E+04 | — | — |
| II-14 | 3.8 | 283 | 74.5 | 7.5 | 1.5 | 7 | 5.0E+11 | 3.7E+10 | −1.40 | ◎ |
| II-15 | 3.8 | 278 | 73.2 | 7.5 | 1.3 | 5 | 2.0E+11 | 7.7E+09 | −1.48 | ◎ |
| II-16 | 3.7 | 259 | 70.0 | 8.0 | 1.4 | 3 | 3.7E+10 | 1.0E+10 | −1.00 | ◎ |
| II-17 | 3.8 | 260 | 68.4 | 8.6 | 1.1 | 3 | 1.1E+10 | 5.6E+08 | −3.07 | ◎ |
| * II-18 | 3.7 | 257 | 69.5 | 8.9 | — | 3 | 1.0E+10 | 6.2E+08 | −7.82 | — |
| II-19 | 3.5 | 285 | 81.4 | 7.5 | 3.2 | 7 | 5.0E+07 | 6.7E+06 | −4.33 | ○ |
| II-20 | 3.4 | 235 | 69.1 | 8.6 | 5.4 | 3 | 9.6E+05 | 1.6E+05 | −4.44 | ○ |
| * II-21 | 3.4 | 195 | 57.4 | 8.9 | — | 3 | 1.0E+05 | 3.2E+04 | — | — |
| * II-22 | 3.4 | 187 | 55.0 | 8.9 | — | 2 | 7.6E+04 | 2.2E+03 | −9.00 | — |
| * II-23 | 3.5 | 200 | 57.1 | 6.8 | — | 7 | — | — | — | — |
| II-24 | 3.4 | 206 | 60.6 | 8.5 | 4.7 | 3 | 9.9E+05 | 1.1E+05 | −4.00 | ○ |
| * II-25 | 3.4 | 190 | 55.9 | 8.8 | — | 3 | 3.0E+05 | 4.1E+04 | −8.63 | — |
| * II-26 | 3.5 | 205 | 58.6 | 6.8 | — | 7 | 2.2E+05 | 5.6E+04 | — | — |

TABLE 7-continued

| Sample No. | Apparent Density ρ (× $10^3$ kg/$m^3$) | Young's Modulus E (GPa) | Specific Rigidity E/ρ (cm) | Linner Expansion Coefficient (× $10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| * II-27 | 3.4 | 198 | 58.2 | 8.4 | — | 3 | 2.9E+05 | 3.9E+04 | — | — |
| * II-28 | 3.4 | 190 | 55.9 | 8.6 | — | 3 | 2.6E+05 | 2.3E+04 | −8.17 | — |
| * II-29 | 3.6 | 230 | 63.9 | 6.7 | — | 7 | — | — | — | — |
| II-30 | 3.5 | 220 | 62.9 | 8.5 | 4.5 | 3 | 2.7E+08 | 2.8E+07 | −3.61 | ○ |
| * II-31 | 3.5 | 195 | 55.7 | 8.7 | — | 3 | 2.0E+08 | 1.9E+07 | −7.54 | — |
| * II-32 | 3.6 | 221 | 61.4 | 6.8 | — | 7 | 2.8E+08 | 1.5E+07 | −5.76 | — |
| * II-33 | 3.7 | 249 | 67.3 | 7.0 | — | 8 | — | — | — | — |
| II-34 | 3.6 | 228 | 63.3 | 8.6 | 4.3 | 3 | 1.7E+09 | 4.8E+08 | −2.60 | ○ |
| * II-35 | 3.5 | 190 | 54.3 | 8.8 | — | 3 | 7.5E+09 | 2.9E+08 | −8.58 | — |
| * II-36 | 3.4 | 198 | 58.2 | 7.0 | — | 8 | 5.0E+05 | 8.8E+04 | — | — |

Sample numbers marked with * are not within the scope of the present invention.
Note:
In volume resistivity, for example. "6.1E+13" means 6.1 × $10^{13}$.

TABLE 8

| Sample No. | Apparent Density ρ (× $10^3$ kg/$m^3$) | Young's Modulus E (GPa) | Specific Rigidity E/ρ (cm) | Linner Expansion Coefficient (× $10^{-6}$/° C.) | Void Occupancy Ratio (%) | Heat Conductivity (W/m · K) | Volume Resistivity −40° C. (Ω · m) | Volume Resistivity 60° C. (Ω · m) | Temp. Coefficiency of volume resistivity (%/° C.) | Evaluation |
|---|---|---|---|---|---|---|---|---|---|---|
| * II-37 | 3.4 | 191 | 56.2 | 8.5 | 11 | 3 | 6.5E+05 | 8.4E+04 | — | — |
| * II-38 | 3.3 | 180 | 54.5 | 8.7 | — | 3 | — | — | — | — |
| * II-39 | 3.8 | 252 | 66.3 | 7.0 | — | 8 | — | — | — | — |
| II-40 | 3.6 | 232 | 64.4 | 8.5 | | 3 | 3.4E+09 | 2.7E+08 | −3.60 | ○ |
| * II-41 | 3.5 | 191 | 54.6 | 8.6 | — | 3 | 7.1E+09 | 2.9E+08 | −8.11 | — |
| * II-42 | 3.5 | 206 | 58.9 | 6.9 | — | 8 | — | — | — | — |
| * II-43 | 3.4 | 193 | 56.8 | 8.5 | 12 | 3 | — | — | — | — |
| * II-44 | 3.3 | 197 | 59.7 | 8.6 | — | 3 | 7.9E+09 | 2.5E+08 | −9.11 | — |
| * II-45 | 3.7 | 290 | 78.4 | 7.0 | — | 9 | — | — | — | — |
| II-46 | 3.6 | 246 | 68.3 | 8.6 | 3.7 | 3 | 6.9E+10 | 7.9E+09 | −3.22 | ○ |
| * II-47 | 3.6 | 194 | 53.9 | 8.7 | — | 3 | 8.0E+10 | 2.9E+09 | −7.71 | — |
| * II-48 | 3.8 | 291 | 76.6 | 7.1 | — | 9 | — | — | — | — |
| II-49 | 3.6 | 231 | 64.2 | 8.5 | 3.8 | 3 | 4.8E+10 | 7.8E+09 | −4.06 | ○ |
| * II-50 | 3.6 | 193 | 53.6 | 8.7 | — | 3 | 7.8E+04 | 2.6E+03 | −8.87 | — |
| * II-51 | 3.6 | 245 | 68.1 | 6.9 | — | 7 | — | — | — | — |
| II-52 | 3.5 | 210 | 60.0 | 8.4 | 4.1 | 3 | 3.3E+08 | 5.8E+07 | −3.13 | ○ |
| * II-53 | 3.5 | 189 | 54.0 | 8.5 | — | 3 | 8.2E+08 | 2.6E+07 | −8.82 | — |
| * II-54 | 3.7 | 239 | 64.6 | 6.9 | — | 7 | 2.7E+05 | 6.2E+04 | — | — |
| * II-55 | 3.5 | 208 | 59.4 | 8.4 | — | 3 | 4.0E+05 | 4.8E+04 | — | — |
| * II-56 | 3.5 | 190 | 54.3 | 8.5 | — | 3 | 7.2E+08 | 2.3E+07 | −9.96 | — |
| * II-57 | 3.6 | 240 | 66.7 | 6.8 | — | 8 | — | — | — | — |
| II-58 | 3.5 | 220 | 62.9 | 8.5 | 4.4 | 3 | 9.5E+08 | 1.2E+08 | −3.61 | ○ |
| * II-59 | 3.5 | 189 | 54.0 | 8.5 | — | 3 | 9.2E+08 | 3.0E+07 | −9.37 | — |
| * II-60 | 3.8 | 275 | 72.4 | 7.0 | — | 7 | — | — | — | — |
| II-61 | 3.6 | 237 | 65.8 | 8.5 | 4.9 | 3 | 3.6E+09 | 4.3E+08 | −3.27 | ○ |
| * II-62 | 3.6 | 195 | 54.2 | 8.6 | — | 3 | 7.3E+09 | 1.8E+08 | −10.17 | — |
| * II-63 | 3.8 | 285 | 75.0 | 7.0 | — | 8 | — | — | — | — |
| II-64 | 3.7 | 239 | 64.6 | 8.5 | 4.2 | 3 | 5.4E+10 | 7.1E+09 | −2.93 | ○ |
| * II-65 | 3.6 | 191 | 53.1 | 8.7 | — | 3 | 8.6E+10 | 2.4E+09 | −8.44 | — |
| * II-66 | 3.6 | 242 | 67.2 | 7.0 | — | 7 | — | — | — | — |
| II-67 | 3.5 | 217 | 62.0 | 8.4 | 3.5 | 3 | 3.7E+08 | 8.2E+07 | −3.31 | ○ |
| * II-68 | 3.5 | 192 | 54.9 | 8.5 | — | 3 | 7.3E+08 | 2.1E+07 | −8.34 | — |
| ** II-69 | 2.2 | 65 | 29.5 | 6.0 | — | 3 | 2.2E+12 | 1.0E+12 | −1.09 | — |
| ** II-70 | 2.3 | 56 | 24.3 | 8.0 | — | 3 | 2.0E+12 | 1.0E+12 | −1.00 | — |
| ** II-71 | 2.8 | 50 | 17.9 | 9.0 | — | 1 | 2.8E+12 | 1.1E+12 | −1.21 | — |
| ** II-72 | 2.4 | 82 | 34.2 | 3.3 | — | 2 | 1.1E+09 | 8.0E+08 | −0.55 | — |

Sample numbers marked with * are not within the scope of the present invention.
Mark ** denotes a comparative sample.
Note:
In volume resistivity, for example, "6.1E+13" means 6.1 × $10^{13}$.

As will be clear from Tables 7 and 8, test pieces Nos.II-2 to 6 including 40 to 90% by weight of alumina and 10 to 60% by weight of calcium titanate showed high values of Young's modulus not less than 300 GPa, specific rigidity (E/ρ) of 80 or higher, a void-occupying area ratio of 2% or less, heat conductivity of 3 W/m·K or higher, thermal expansion coefficient in a range from $7.5\times10^{-6}$ to $10\times100^{-6}$/° C. in a range from ordinary temperature to 400° C., volume resistivity in a range from $1\times10^{5}$ to $1\times10^{10}$ Ω·m in a temperature range from −40 to 60° C. and temperature coefficient of volume resistivity in a range from −5 to 5%/° C. in the temperature range from −40 to 60° C., and were rated as ◎ or ○ for satisfactory use as the spacer or the back panel of FED.

Test pieces including 40 to 90% by weight of alumina and 10 to 60% by weight of calcium titanate as major components with 30 parts by weight or less additive components contained based on 100 parts by weight of the sum total of alumina and calcium titanate, the additive components including 15 to 90% by weight of manganese dioxide, 3 to 40% by weight of an oxide of group 5*a* element and 5 to 80% by weight of oxide of iron group element (Nos.II-14 to 17, 19, 20, 24, 30, 34, 40, 46, 49, 52, 58, 61, 64, 67) showed high values of Young's modulus not lower than 200 GPa, high specific rigidity (E/ρ) of 60 or higher, a void-occupying area ratio of 6% or less, heat conductivity of 3 W/m·K or higher, thermal expansion coefficient in a range from $7.5\times10^{-6}$ to $10\times10^{-6}$/° C. in a range from ordinary temperature to 400° C., volume resistivity in a range from $1\times10^{5}$ to $1\times10^{10}$ Ω·m in a temperature range from −40 to 60° C. and temperature coefficient of volume resistivity in a range from −5 to 5%/° C. in the temperature range from −40 to 60° C., and were rated as ◎ or ○ for satisfactory use as the spacer or the back panel of FED.

Test pieces Nos.II-13, 21, 22, 26, 27, 36, 37, 54 and 55, in contrast, did not show volume resistivity of $1\times10^{5}$ Ω·m or less in a temperature range from −40 to 60° C. Test pieces Nos.II-7, 18, 22, 25, 28, 31, 32, 35, 41, 44, 47, 50, 53, 56, 59, 62, 65 and 68 did not show temperature coefficient of volume resistivity not lower than 5%/° C. in the temperature range from −40 to 60° C. Test piece No. 10 did not make dense sintering and failed to achieve the desired characteristics.

Test pieces Nos.II-1, 7, 8, 9, 11, 12, 13, 23, 26, 29, 32, 33, 36, 39, 42, 45, 48, 51, 54, 57, 60, 63, 66 did not have linear expansion coefficient in a range from $7.5\times10^{-6}$ to $10\times10^{-6}$/° C. in a range from ordinary temperature to 400° C.

Glass of the comparative examples, as is clearly indicated by test pieces Nos.II-69 to 72, all showed heat conductivity of 3 W/m·K or lower, test pieces Nos. II-69, 70 and 71 showed specific rigidity of $30\times10^{9}$ cm or lower, and test pieces Nos.II-69 and 72 showed low values of linear expansion coefficient of $6.0\times10^{-6}$/° C. and $3.3\times10^{-6}$/° C., respectively.

EXAMPLE III

Alumina powder, calcium titanate powder and zirconia powder were prepared. These powdery materials were weighed to such proportions corresponding to the composition of the ceramic shown in Table 9, and were mixed in wet process in a rotary mill. Slurry of the mixture was spray-dried to make a material cake for sintering.

The material cake was formed into shape by pressing, and was sintered in non-oxidizing atmosphere at the temperature shown in Table 9 for two hours, thereby making samples of spacer shown in FIG. 1. Compositions of the test pieces are shown in Table 9.

TABLE 9

| | Composition | | | |
|---|---|---|---|---|
| | | Balance | | Sintering |
| Sample No. | $ZrO_2$ (wt. %) | $Al_2O_3$ (wt. %) | TiC (wt. %) | Temperature (° C.) |
| III-1 | 25.0 | 95.0 | 5.0 | 1775 |
| III-2 | 55.0 | 95.0 | 5.0 | 1725 |
| III-3 | 22.0 | 93.0 | 7.0 | 1800 |
| III-4 | 25.0 | 93.0 | 7.0 | 1775 |
| III-5 | 35.0 | 93.0 | 7.0 | 1750 |
| III-6 | 55.0 | 93.0 | 7.0 | 1725 |
| III-7 | 57.0 | 93.0 | 7.0 | 1700 |
| III-8 | 25.0 | 85.0 | 15.0 | 1725 |
| III-9 | 35.0 | 85.0 | 15.0 | 1750 |
| III-10 | 55.0 | 85.0 | 15.0 | 1700 |
| III-11 | 22.0 | 72.0 | 28.0 | 1800 |
| III-12 | 25.0 | 72.0 | 28.0 | 1800 |
| III-13 | 35.0 | 72.0 | 28.0 | 1775 |
| III-14 | 55.0 | 72.0 | 28.0 | 1750 |
| III-15 | 57.0 | 72.0 | 28.0 | 1725 |
| III-16 | 25.0 | 70.0 | 30.0 | 1800 |
| III-17 | 55.0 | 70.0 | 30.0 | 1775 |

The test pieces thus obtained were evaluated similarly to Example 1, with the results as shown in Table 10.

TABLE 10

| Sample No. | Apparent Density ρ (× $10^3$ kg/m$^3$) | Young's Modulus E (GPa) | Rigidity E/ρ (cm) | Linner Expansion Coefficient (× $10^{-6}$/° C.) | Void Occupancy Ratio (%) | Specific Heat Conductivity (W/m · K) | Flexaral Strength (MPa) | Volume Resistivity −40° C. (Ω · m) | Volume Resistivity 60° C. (Ω · m) | Temp. Coefficiency of volume resistivity (%) | Evaluation |
|---|---|---|---|---|---|---|---|---|---|---|---|
| III-1 | 4.5 | 340 | 75.6 | 8.1 | 0.2 | 18 | — | 3.8E+11 | 1.1E+09 | −11.84 | — |
| III-2 | 5.0 | 315 | 63.0 | 8.8 | 0.5 | 6 | — | 6.2E+11 | 4.3E+09 | −11.19 | — |
| III-3 | 4.4 | 342 | 77.7 | 7.8 | — | — | — | — | — | — | — |
| III-4 | 4.5 | 339 | 75.3 | 8.1 | 0.3 | 17 | 506 | 4.6E+10 | 8.6E+09 | −3.74 | ○ |
| III-5 | 4.6 | 337 | 73.3 | 8.4 | 0.3 | 14 | 627 | 5.1E+10 | 9.8E+09 | −2.06 | ○ |
| III-6 | 5.0 | 312 | 62.4 | 8.8 | 0.8 | 5 | 659 | 5.6E+10 | 8.9E+09 | −1.62 | ○ |
| III-7 | 5.1 | 278 | 54.5 | 9.2 | — | — | — | — | — | — | — |
| III-8 | 4.6 | 335 | 72.8 | 8.1 | 0.9 | 17 | 512 | 1.1E+08 | 6.9E+07 | −0.84 | ◎ |
| III-9 | 4.7 | 328 | 69.8 | 8.5 | 1.0 | 12 | 647 | 2.8E+08 | 1.3E+08 | −0.58 | ◎ |
| III-10 | 5.1 | 311 | 61.0 | 8.9 | 1.3 | 5 | 663 | 3.7E+08 | 2.7E+08 | −0.29 | ◎ |
| III-11 | 4.6 | 340 | 73.9 | 7.9 | — | — | — | — | — | — | — |
| III-12 | 4.7 | 332 | 70.6 | 8.2 | 1.2 | 16 | 509 | 3.9E+05 | 1.0E+05 | −1.38 | ○ |
| III-13 | 4.8 | 321 | 66.9 | 8.6 | 1.5 | 9 | 655 | 4.8E+05 | 1.1E+05 | −1.32 | ○ |

TABLE 10-continued

| Sample No. | Apparent Density ρ (× $10^3$ kg/$m^3$) | Young's Modulus E (GPa) | Rigidity E/ρ (cm) | Linner Expansion Coefficient (× $10^{-6}$/° C.) | Void Occupancy Ratio (%) | Specific Heat Conductivity (W/m · K) | Flexaral Strength (MPa) | Volume Resistivity −40° C. (Ω · m) | Volume Resistivity 60° C. (Ω · m) | Temp. Coefficiency of volume resistivity (%) | Evaluation |
|---|---|---|---|---|---|---|---|---|---|---|---|
| III-14 | 5.1 | 308 | 60.4 | 8.9 | 1.8 | 5 | 671 | 5.5E+05 | 3.2E+05 | −0.55 | ○ |
| III-15 | 5.3 | 269 | 50.8 | 9.2 | — | — | — | — | — | — | — |
| III-16 | 4.8 | 328 | 68.3 | 8.3 | 2.2 | 16 | — | 5.6E+04 | 3.2E+03 | −7.54 | — |
| III-17 | 5.0 | 302 | 58.1 | 9.0 | — | — | — | — | — | — | — |

Note:
In volume resistivity, for example, "3.8E+11" means 3.8 × $10^{11}$.

As will be clear from Table 10, test pieces Nos.III-4, 5, 6, 8, 9, 10, 12, 13, 14 including 25 to 55% by weight of zirconia with the balance being alumina and titanium carbide, specifically 72 to 93% by weight of alumina and 7 to 28% by weight of titanium carbide based on 100% by weight of the sum total of alumina and titanium carbide, showed high values of Young's modulus not less than 300 GPa, high flexural strength of 500 MPa or higher, high specific rigidity (E/ρ) of 60 or higher, a void-occupying area ratio of 2% or less, heat conductivity of 5 W/m·K or higher, thermal expansion coefficient in a range from $8\times10^{-6}$ to $9\times10^{-6}$/° C. in a temperature range from ordinary temperature to 400° C., volume resistivity in a range from $1\times10^{5}$ to $1\times10^{12}$ Ω·m in a temperature range from −40 to 60° C. and temperature coefficient of volume resistivity in a range from −5 to 5%/° C. in the temperature range from −40 to 60° C., and were rated as ◎ or ○ for satisfactory use as the spacer or the back panel of FED.

Test pieces Nos.III-1, 2, 8 and 17, in contrast, did not show temperature coefficient of volume resistivity in a range from −5 to 5%/° C. in the temperature range from −40 to 60° C. Test piece No.III-16 did not show volume resistivity in a range from $1\times10^{5}$ to $1\times10^{12}$ Ω·m in the temperature range from −40 to 60° C., and test pieces Nos.III-1, 2, 8 and 17.

Test pieces Nos.III-7 and 16 showed low specific rigidity of $60\times10^{9}$ cm or lower, and test pieces No. III-3, 7, 8, 12 and 16 did not showed linear expansion coefficient in a range from $8\times10^{-6}$ to $9\times10^{-6}$/° C. in temperature range from ordinary temperature to 400° C.

What is claimed is:

1. A member for display apparatus used in a display apparatus comprising a back panel on which electron sources are provided and a front panel that are disposed to oppose the back panel via spacers, said member comprising a ceramic that has a Young's modulus (E) of not lower than 120 GPa, a specific rigidity (E/ρ) of not lower than $40\times10^{9}$ cm, a coefficient of linear expansion of $7.5\times10^{-6}$ to $10\times10^{-6}$/° C. in a temperature range from ordinary temperature to 400° C., and a void-occupying area ratio of 6% or less.

2. The member for display apparatus according to claim 1, wherein a volume resistivity is in a range from $1\times10^{5}$ to $1\times10^{12}$ Ω·m in a temperature range from −40 to 60° C. and a temperature coefficient of a volume resistivity is in a range from −5 to 5%/° C.

3. The member for display apparatus according to claim 1, wherein the ceramic comprises 40 to 90% by weight of at least one selected from alumina, forsterite and steatite, and 10 to 60% by weight of a component represented by the general formula $ABO_3$ wherein A represents an element selected from Mg, Ca, Sr and Ba, and B represents an element selected from Ti, Si and Sn.

4. The member for display apparatus according to claim 3, wherein the ceramic contains 30 parts by weight or less of additive components based on 100 parts by weight of the sum total of the weight of the at least one selected from alumina, forsterite end steatite and the weight of the component represented by the general formula $ABO_3$, and wherein the additive components comprise 15 to 90% by weight of manganese dioxide, 3 to 40% by weight of an oxide of a group 5*a* element in periodic table and 5 to 80% by weight of an oxide of an iron group element.

5. The member for display apparatus according to claim 3, wherein the ceramic contains 40 to 90% by weight of alumina, while the element represented by A in the general formula is Ca and the element represented by B is Ti.

6. The member for display apparatus according to claim 1, wherein the ceramic comprises 40 to 90% by weight of at least one selected from alumina, forsterite and steatite, and 10 to 60% by weight of component represented by the general formula $MO_2$ wherein M represents an element selected from Ti, Si, Sn and Pb.

7. The member for display apparatus according to claim 6, wherein the ceramic contains 30 parts by weight or less additive components based on 100 parts by weight of the sum total of the weight of the at least one selected from alumina, forsterite and steatite and the weight of the component represented by the general formula $MO_2$, and wherein the additive components comprise 15 to 90% by weight of manganese dioxide, 3 to 40% by weight of an oxide of group 5*a* element in periodic table and 5 to 80% by weight of an oxide of iron group element.

8. The member for display apparatus according to claim 1, wherein the ceramic comprises 40 to 90% by weight of at least one selected from alumina, forsterite and steatite, and 10 to 60% by weight of component represented by the general formula XO wherein X represents an element selected from Mg, Ca, Sr and Ba.

9. The member for display apparatus according to claim 8, wherein the ceramic contains 30 parts by weight or less additive components based on 100 parts by weight of the sum total of the weight of the at least one selected from alumina, forsterite and steatite and the weight of the component represented by the general formula XO, and wherein the additive components comprise 15 to 90% by weight of manganese dioxide, 3 to 40% by weight of an oxide of group 5*a* element in periodic table and 5 to 80% by weight of an oxide of an iron group element.

10. The member for display apparatus according to claim 1, wherein the ceramic comprises 25 to 55% by weight of zirconia with the balance being alumina and titanium carbide, wherein a proportion of alumina is from 72 to 93% by weight and that of titanium carbide is 7 to 28 by weight based on 100% by weight of the sum total of alumina and titanium carbide.

11. A display apparatus comprising the member for display apparatus of claim 1.

12. A display apparatus comprising the member for display apparatus of claim 2.

13. A display apparatus comprising the member for display apparatus of claim 3.

14. A display apparatus comprising the member for display apparatus of claim 10.

* * * * *